US005314030A

United States Patent [19]

Peterson et al.

[11] Patent Number: 5,314,030

[45] Date of Patent: May 24, 1994

[54] SYSTEM FOR CONTINUOUSLY GUIDED DRILLING

[75] Inventors: Carl R. Peterson, Boxford, Mass.; Peter J. Maloney, Inkster, Mich.

[73] Assignee: Massachusetts Institute of Technology, Cambridge, Mass.

[21] Appl. No.: 928,935

[22] Filed: Aug. 12, 1992

[51] Int. Cl.[5] ..... E21B 7/08; E21B 47/024

[52] U.S. Cl. ..... 175/26; 175/45; 175/61; 33/304; 33/308

[58] Field of Search ..... 175/26, 45, 424, 61; 33/304, 306, 308, 313

[56] References Cited

U.S. PATENT DOCUMENTS

| | | | |
|---|---|---|---|
| 1,313,367 | 8/1919 | Auschutz-Kaempfe . | |
| 2,046,956 | 7/1936 | Lynch et al. | 175/45 |
| 2,380,520 | 7/1945 | Hassler . | |
| 3,359,782 | 12/1967 | Van Bey . | |
| 3,791,042 | 2/1974 | Bell | 33/304 |
| 3,897,837 | 8/1975 | Peterson | 175/228 |
| 4,216,590 | 8/1980 | Kelly | 33/304 |
| 4,637,479 | 1/1987 | Leising | 175/26 |
| 4,930,586 | 6/1990 | Turin et al. | 175/424 X |

FOREIGN PATENT DOCUMENTS

| | | | |
|---|---|---|---|
| 2407457 | 6/1979 | France | 33/308 |
| 1030527 | 7/1983 | U.S.S.R. | 175/45 |

OTHER PUBLICATIONS

Charles T. Davenport, "The Gyro Vertical," Gyroscopes: Theory and Design, Chapter 6, pp. 131–150, 1961.

Peterson and Maloney, "A System for Continuously Guided Rock Drilling", presented on Jan. 26–29, 1992 at Engineering For a Sustained Environment, Adam's Mark Hotel, Houston, Tex.

Slaughter, "Development, Laboratory, and Field Test Results of a New Hydraulic Design for Roller Cone Rock Bits," SPE 14220, Sep. 1985.

Maloney, Peter J., S. M. Thesis, Massachusetts Institute of Technology, deposited in the MIT Library on Dec. 13, 1992.

*Primary Examiner*—David J. Bagnell

*Attorney, Agent, or Firm*—Fish & Richardson

[57] ABSTRACT

The invention provides a system for precisely guiding the direction of a drill bit. The drill shaft has an orientation sensor that detects deviation of the drilling direction from the desired direction; the drill bit is steerable by preferentially directing flushing fluid at the drilling end; and a fluid modulation means controls the flushing in response to a signal from the orientation sensor. The invention also provides a tiltmeter for detecting deviation from vertical of the axis of rotation of a rotating shaft. A gravity-driven mechanical oscillator, for instance a pendulum, is carried by the rotating shaft, and has a natural oscillation frequency matched to the rotational frequency of the shaft; and a sensor determines the phase relationship of the oscillator relative to the angular position of the shaft, thereby producing a signal indicating the deviation of the shaft from vertical.

45 Claims, 14 Drawing Sheets

Frame 1. Left Nozzle At Low Pressure Drop

Frame 2. Equal Pressure Drop

Frame 3. Right Nozzle At Low Pressure Drop

Nozzle Velocity vs. Time

SYSTEM FOR CONTINUOUSLY GUIDED DRILLING

Funding of the work described herein was provided by the federal government, which has certain rights in the invention.

BACKGROUND OF THE INVENTION

The invention relates to systems for drilling into the surface of the earth, and in particular to such systems incorporating means to measure and guide the bit to the desired direction.

In nuclear weapons testing, the mining industry, and the oil industry, there is a need for guided drilling or coring. In the case of the mining and oil industries, a subsurface location containing a desirable resource sometimes needed to be reached by a hole that is as straight as possible (McCray, Arthur and Cole, Frank, *Oil Well Drilling Technology,* Norman: Univ. of Oklahoma Press, 1967; 306). A "straight" hole in this case is not only the shortest distance from the surface to the location of interest, but also is parallel to the local gravity vector. FIG. 1 illustrates what happens when a bit deviates from an ideally straight path. The bit starts at point A, and instead of going to the ideal point B, it ends at point C. The deviated point C defines the error in terms of the deviation angle $\alpha$, or the distance from the ideal endpoint $\delta$.

Hole deviation is caused by non-uniform formations and inclined rock strata, and in the case of a conventional bit, can be accelerated by the bending of the drill string. With a conventional bit, a hole is usually considered straight if the deviation angle $\alpha$ is less than 5 degrees.

In nuclear weapons testing the CORRTEX method is proposed to verify the strength of nuclear bomb blasts. This method involves drilling a straight hole near the bomb and inserting a tube or "core" in the hole. When the blast occurs, the core is crushed at a rate indicative of the blast strength (Norman C. "Test Ban Talks Reach Impasse (Seismic Detection vs. CORRTEX)." *Science* April 15, 1988; 273). The "straightness" requirement for this kind or hole is a deviation distance $\delta$ of 2 feet in a 2000 foot deep hole. The hole deviation angle $\alpha$ in this case is only 0.057 degrees.

Precise vertical drilling, in general, requires slow drilling rates so that the drilling assembly seeks the vertical. During a conventional vertical drilling, the drill steel is stopped in order to measure the orientation of the hole and determine the proper correction, only then the drilling is resumed. Some conventional steering methods require placing a metal wedge on the bottom of the hole to deflect the drill to the desired direction, or using a hydraulic piston pushing against the wall of the hole to deflect and re-orient the drill. Thus, this type of straight-hole vertical drilling is slow and also dependent on the geological conditions.

In summary, there is a need for a continuously guided drilling system which can operate at conventional drilling rates of tens of feet per hour or higher.

SUMMARY OF THE INVENTION

The present invention is a guided drilling method and system for drilling in a desired direction with a dynamic control of a drill shaft (or drill string). The controlled shaft need not be stopped periodically during drilling to check its current direction. The invention also enables a high degree of accuracy in the direction of the hole produced. This accuracy is sufficient, according to simulations and experiments, to satisfy stringent straightness requirements; for example, the hole straightness of the CORRTEX nuclear weapons test method.

In one general aspect the invention features a method and system for guided drilling in a desired direction including a rotatable drilling shaft driven by a motor adapted to drive the drilling shaft; an orientation sensor, located on the rotatable drilling shaft, constructed and arranged to detect deviation of the shaft from the desired direction during rotation of the shaft while drilling, the sensor being adapted to produce control signals dependent upon the detected deviation; a steerable pilot bit, mounted on the end of the drilling shaft, adapted to drill in the desired direction by utilizing multiple fluid jets disposed to provide preferential flushing at a selected region; a tight stabilizer mounted on a stiff section of the drilling shaft at a location spaced substantially above the steerable bit to provide a known pivot point for deflection of the stiff section; and fluid modulation means responsive to the tiltmeter, adapted to regulate the jets of fluid to achieve preferential flushing in response to the signals from the sensor to correct detected deviation of the shaft from the desired direction.

In another general aspect the invention features a method and system for guided drilling in a desired direction including a rotatable drilling shaft driven by a motor adapted to drive the drilling shaft; an orientation sensor, located on the rotatable drilling shaft, constructed and arranged to detect deviation of the shaft from the desired direction during rotation of the shaft while drilling, the sensor adapted to produce control signals dependent upon the detected deviation; a steerable pilot bit, mounted on the end of the drilling shaft, adapted to drill in the desired direction by utilizing a mechanical cutter in conjunction with multiple fluid jets disposed to provide preferential flushing at a selected region; a conical reamer mounted on a stiff section of the drilling shaft at a location spaced substantially above the steerable pilot bit to provide a known pivot point for deflection the enables correction of the direction of drilling by the pilot bit, the conical reamer adapted to enlarge the diameter of a hole formed by the pilot bit while providing a tight lateral constraint to the shaft; and fluid modulation means, responsive to the sensor, adapted to regulate the jets of fluid to achieve preferential flushing in response to the signals from the sensor to correct detected deviation of the shaft from the desired direction.

Preferred embodiments of these aspects of the invention include one or more of the following features.

The orientation sensor is a tiltmeter that includes a mechanical oscillator carried by the rotatable shaft, the mechanical oscillator includes a mass disposed in a generally neutral position when the shaft, while rotating is oriented in the desired direction and being caused to oscillate by gravity action when the shaft, while rotating, deviates from the desired direction; the oscillator being adapted to have its natural frequency of oscillation matched to the operating frequency of rotation of the shaft, enabling the oscillator to amplify tilt-induced oscillations; a transducer coupled to the oscillator adapted to sense the oscillations of the oscillator; and indication means, responsive to the transducer, for determining the phase relationship of the oscillations relative to the angular position of the shaft and producing signals of the shaft deviation from the desired direction.

The steerable bit includes a modified roller bit having cutter cones adapted to provide a chamfered hole bottom.

The steerable bit includes a roller cutter adapted for controlled drilling in a desired direction; and multiple jet nozzles, each connected to a fluid passage delivering the fluid to the respective nozzle, adapted to introduce the fluid to the selected region in order to increase drilling rate in the region.

The fluid modulation means include a flow control valve adapted to direct the fluid to the fluid passage of a selected nozzle in order to achieve the preferential flushing.

The flow control valve includes a rotating disc adapted to control delivery of the fluid to the fluid passages.

The drilling system includes a motor control means adapted to maintain the speed of the motor driving the drilling shaft at frequency matched with the natural frequency of the mechanical oscillator.

The fluid modulation means receive the signals from the indication means and directs the fluid to the selected region in order to maintain the shaft in a desired orientation.

The fluid modulation means are constructed and adapted to maintain the shaft vertical in order to drill a vertical hole without stopping the rotation of the shaft.

The fluid modulation means receives the signals from the indication means either nearly continually or intermittently.

The indication means of the tiltmeter obtain the signals by determining a direction of tilt that leads the oscillations of the mechanical oscillator by 90°.

The natural frequency of the mechanical oscillator is dynamically adjustable, and the tiltmeter further including means for matching the natural frequency to the frequency of rotation of the shaft.

The mechanical oscillator is a pendulum including a mass pivotably mounted within the shaft. The pendulum can be constrained to move in a plane. The pendulum can include a flexure mounted within the shaft and pivotably supports the mass.

The transducer means include a strain gauge.

In another general aspect the invention features a method and system for detecting deviation from vertical of a rotating shaft using a tiltmeter mounted on the shaft and including a mechanical oscillator carried by the rotatable shaft, the mechanical oscillator including a mass disposed in a generally neutral position when the shaft, while rotating is vertical and being caused to oscillate by gravity action when the shaft, while rotating, deviates from the vertical; the oscillator adapted to have its natural frequency of oscillation matched to the operating frequency of rotation of the shaft, to enable the oscillator to amplify tilt-induced motion of the oscillator; a transducer coupled to the oscillator adapted to sense the oscillations of the oscillator; and indication means responsive to the transducer for determining the phase relationship of the oscillations relative to the angular position of the shaft and producing the signals of the shaft deviation from vertical.

Preferred embodiments of this aspect of the invention include one or more of the following features.

The indication means of the tiltmeter obtain the signals by determining a direction of tilt that leads the oscillations of the mechanical oscillator by 90°.

The natural frequency of the mechanical oscillator is dynamically adjustable, and the tiltmeter further including means for matching the natural frequency to the frequency of rotation of the shaft.

The mechanical oscillator is a pendulum including a mass pivotably mounted within the shaft. The pendulum can be constrained to move in a plane. The pendulum can include a flexure mounted within the shaft and pivotably supports the mass.

DESCRIPTION OF THE PREFERRED EMBODIMENT

Figure 1:
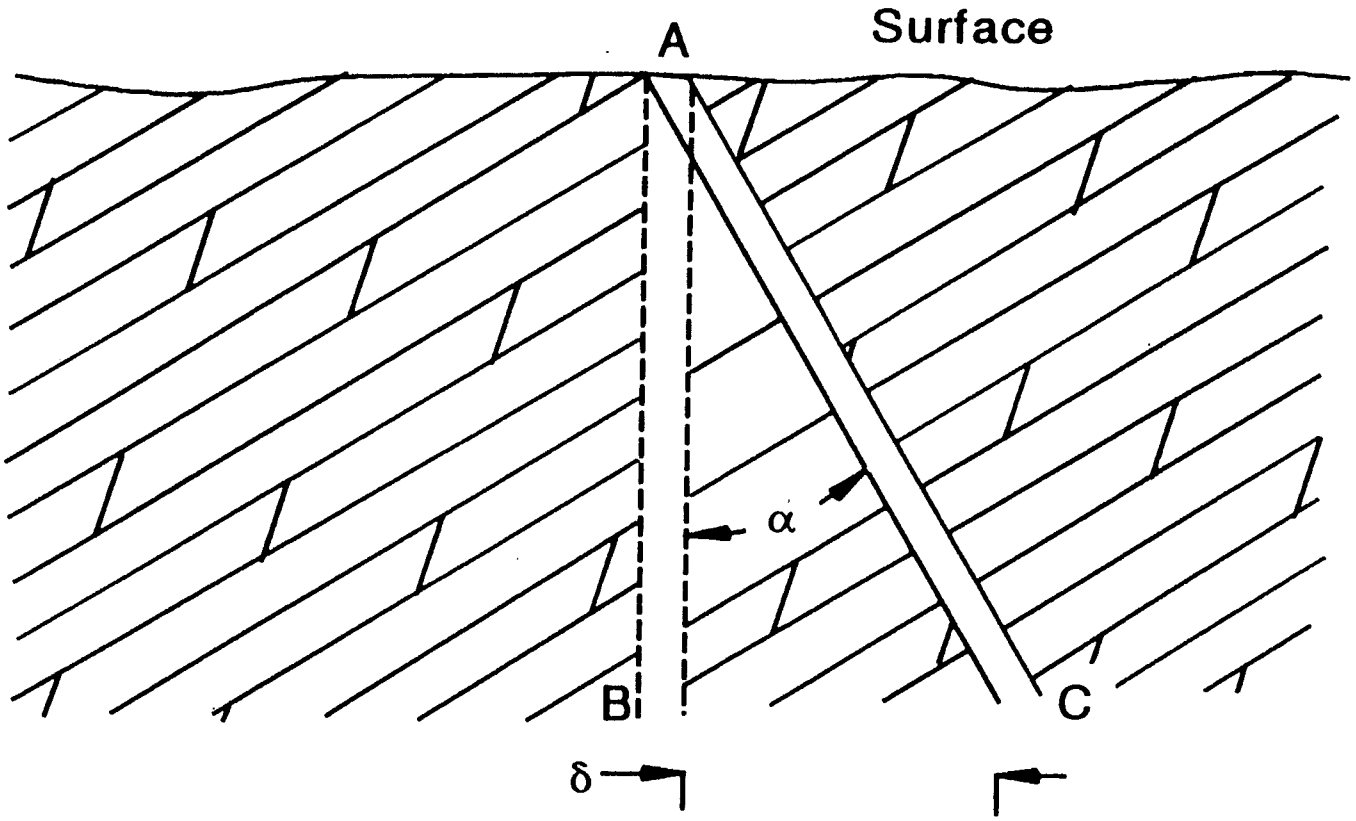
FIG. 1 is a sectional diagram through a portion of the earth's surface, showing an inclined hole bored through this surface. A vertical reference hole is also shown in phantom.
Figure 2:
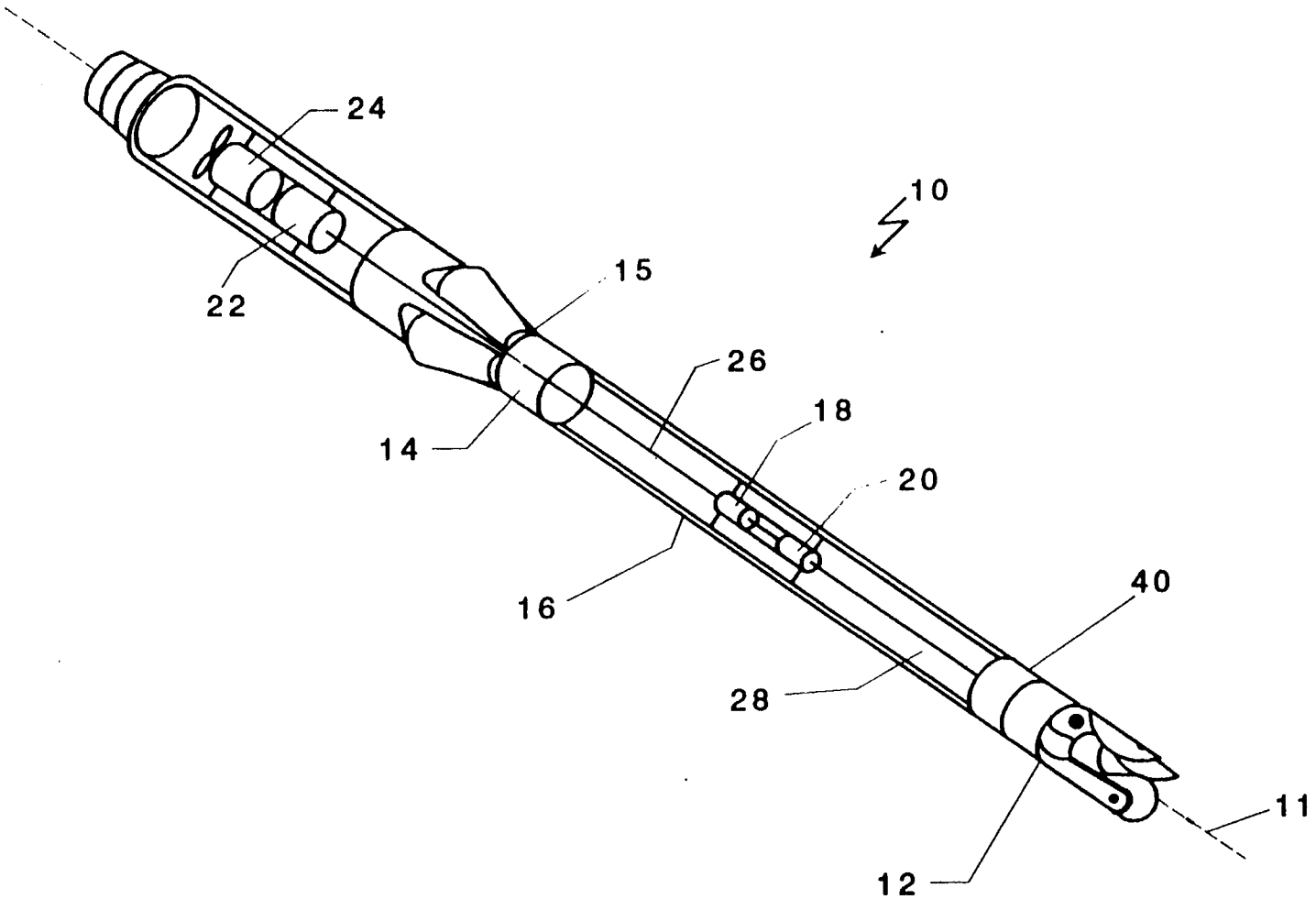
FIG. 2 is a diagrammatic perspective view of a drilling assembly according to the invention.

Referring to FIG. 2, a drilling assembly 10 according to the invention includes a special steerable pilot bit 12, a conical reamer 14 and a stiff drill steel case 16. Drill steel case 16 contains an orientation sensor such as a rotational tiltmeter 18, computer 20 and a battery 22 coupled to a fluid-driven generator 24. Generator 24 provides electrical power for downhole control components. A power and signal line 26 provides an electrical path between the battery and rotational tiltmeter 18, and a signal line 28 provides an electrical path from analog computer 20 to the special steerable pilot bit 12.

The purpose of pilot bit 12 (shown in detail in FIG. 3) is to provide an entrance for conical reamer 14 (such as the conical reamer designed by RAPIDEX INC.) and to cause direction changes continuously while using the conical reamer as a well-defined pivot point and hole opener. The end of drilling assembly 10 is free to pivot around a pivot point 15 at conical reamer 14. Pilot bit 12 utilizes this pivot point 15 and tiltmeter 18 for controlled lateral penetration. Pilot bit 12 guides drilling assembly 10 in the desired direction and conical reamer 14 rotatably wedges the hole and increases its diameter. Conical reamer 14 provides extremely tight lateral constraint as it excavates the formation. This reduces vibration on the assembly below conical reamer 14 and also reduces the noise in tiltmeter 18 located below pivot point 15. The lateral penetration of pilot bit 14 about well defined pivot point 15 is controlled by tiltmeter 18 and a steerable assembly 40.

Figure 3:
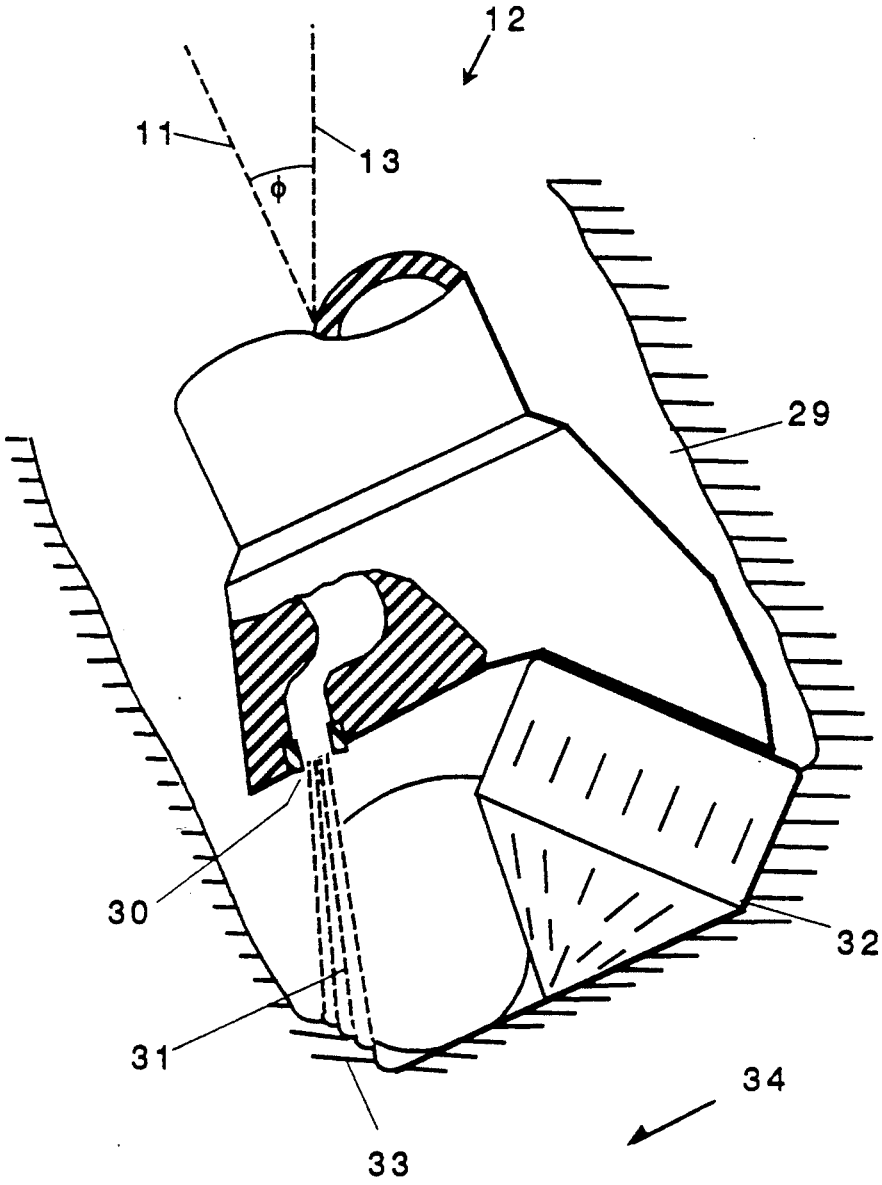
FIG. 3 is a diagrammatic perspective view of a steerable pilot bit according to the invention.

Steerable pilot bit 12, shown schematically in FIG. 3, has mechanical cutters such as roller cutters 32 of a conical shape to provide a conical hole bottom portion 33 or chamfer around the periphery of the hole bottom (exaggerated here for clarity). Ordinarily, such a bit would deflect laterally in response to nonuniform formations, producing crooked holes 29, much like a dull conventional bit having rounded corners. Conical portion 33 in conjunction with preferential hole bottom flushing, discussed below, will provide controlled lateral penetration.

The proper steering of pilot bit 12 is achieved by preferential, directional flushing of the bottom of hole 29. Fluid 31 is preferentially directed to the conical portion 33 on the side where greater lateral penetration is desired (the "low" side of FIG. 3 for a vertical-seeking system), with less or no fluid directed to the opposite side. Fluid 31 removes the crushed chips from the hole bottom.

It has been known that penetration rates vary substantially with varying flushing intensity, and that well-directed, moderately high pressure flushing can substantially increase the penetration rate of otherwise conventional mechanical devices (M. Hood, "Mechanism of Fracture of Hard Rock Using a Drag Bit Assisted by Waterjets," *Erosion: Prevention and Useful Applications*. ATTM STP669. W. F. Adler, Ed., American Society for Testing and Materials, 1979, p. 553). At pressures about 3000 psi, the drilling rate begins to increase dramatically. It is thought that at this pressure the chips that are crushed at the hole bottom by bit 32 are lifted from the hole bottom, rather than pushed into it, thereby enhancing the penetration rate of the bit. Slaughter (J. R. Slaughter, "Development, Laboratory, and Field Test Results of a New Hydraulic Design for Roller Cone Rock Bits," SPE 14220, Las Vegas, Nev., Sept. 22–25, 1985) discovered that even small changes in the angular orientation of the flushing nozzles on conventional bits (i.e. 10 to 15 degrees) can increase the bit penetration rate by up to 40%. Thus, a 5% penetration rate increase on the flushed side relative to an unflushed opposite side, should be readily attainable, and calculations have shown that this will result in a sharply turning hole.

Figure 4:
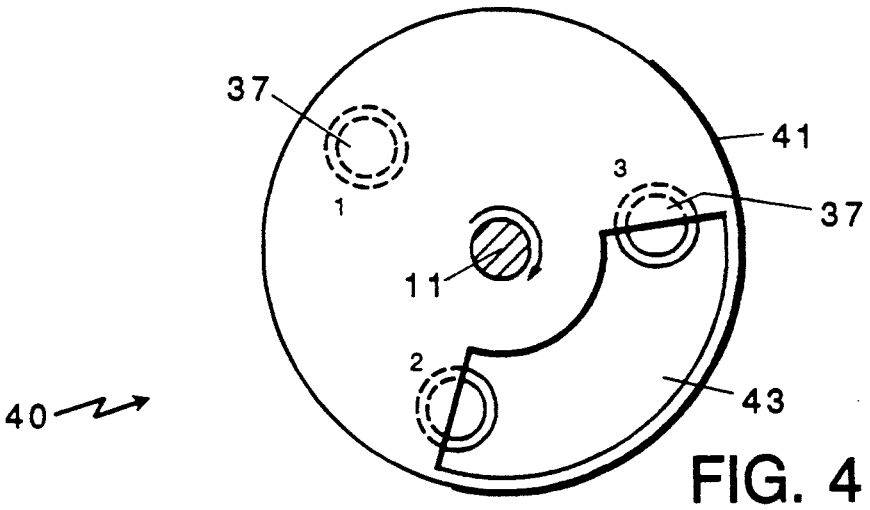
FIGS. 4 and 4E are top and side diagrammatic perspective views, respectively, of a preferred embodiment of a preferential flushing system according to the invention.

Referring to FIGS. 3 and 4, in addition to the foregoing drilling components, drilling assembly 10 includes a steerable assembly 40 that, according to the invention, has a valve 41 that modulates the flushing flow, and directs the flow only to that portion where enhanced lateral penetration is desired. The modulating valve is connected to a sensing and control system. Thus, steering is achieved by controlled lateral penetration, without the need for externally generated lateral forces on the drilling assembly.

The steerable pilot bit employs three roller bits 32 having cutters of substantially conical shape, with fluid passages or nozzles 30 to direct three flushing jets 31 at the hole bottom between the rollers. Jets 31 are aimed to impinge in the chamfered corner area. Each jet has a separate fluid passage 37 to carry the flow to the jet. (An alternative embodiment includes two valved passages with an additional steady-flow passage, or just two valved passages with no third passage.) To avoid problems elsewhere in the fluid system, it is desirable to arrange valving so that the fluid pressure remains reasonably constant as fluid is directed form one passage to another.

Figure 4E:
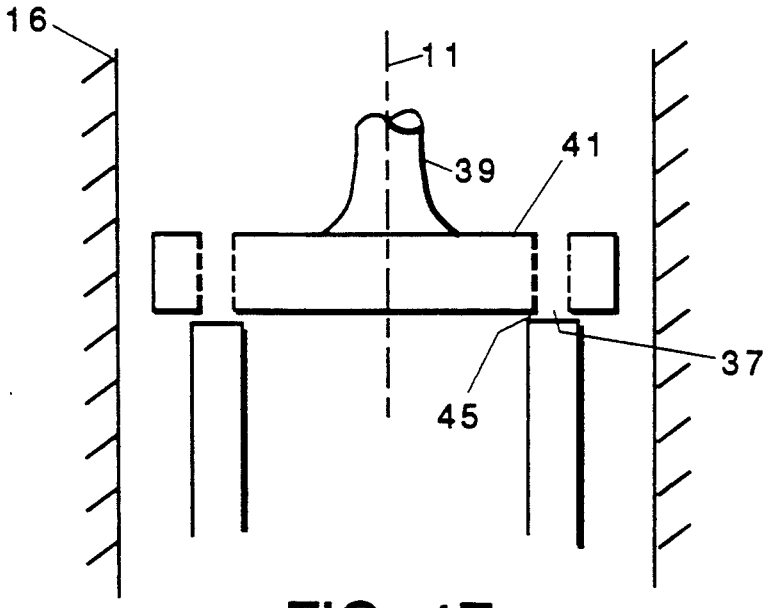

Referring to FIGS. 4 and 4E, a preferred embodiment of the invention uses three equally spaced fluid passages 37 and a rotating disc 41 containing a 120 degree arc or slot opening 43. This arrangement provides a total valve flow area equal to that of one passage, as disc 41 rotates about axis 11. For example, if the disc were rotated backward relative to the drilling assembly exactly at the drilling rpm, flushing fluid would exit within a 120-degree arc fixed in space. Hole deviation would then occur in a single plane, centered on that arc.

Alternatively, the invention envisions a rotating disc having a 240-degree open arc, yielding a 240-degree arc of flushing which is an equivalent of two open holes. Since the drilling mud contains residual cuttings and chips, the assembly does not have tight valve clearances 45 for absolute shut off. The steering is provided by a motor that drives shaft 39 and is controlled by tiltmeter 18. If a deflection of pilot bit 12 in one direction is desired, disc 41 is driven by the motor at drill pipe rpm so the disc 41 remains stationary with respect to the hole. The phase angle of disc 41 is adjusted so that open arc 43 is centered over the low side of the hole. This directs major fluid flow to the low side which will cause pilot bit 12 to move in direction 34 (FIG. 3), as discussed above. If no steering effect is desired, disc 41 is stopped over one fluid passage 37 so that one flushing jet rotates with the drill shaft; this yields no asymmetric flushing.

The power requirements for the valve operation are very small relative to the power of the flushing fluid supplied by the mud pump.

Figure 4A:
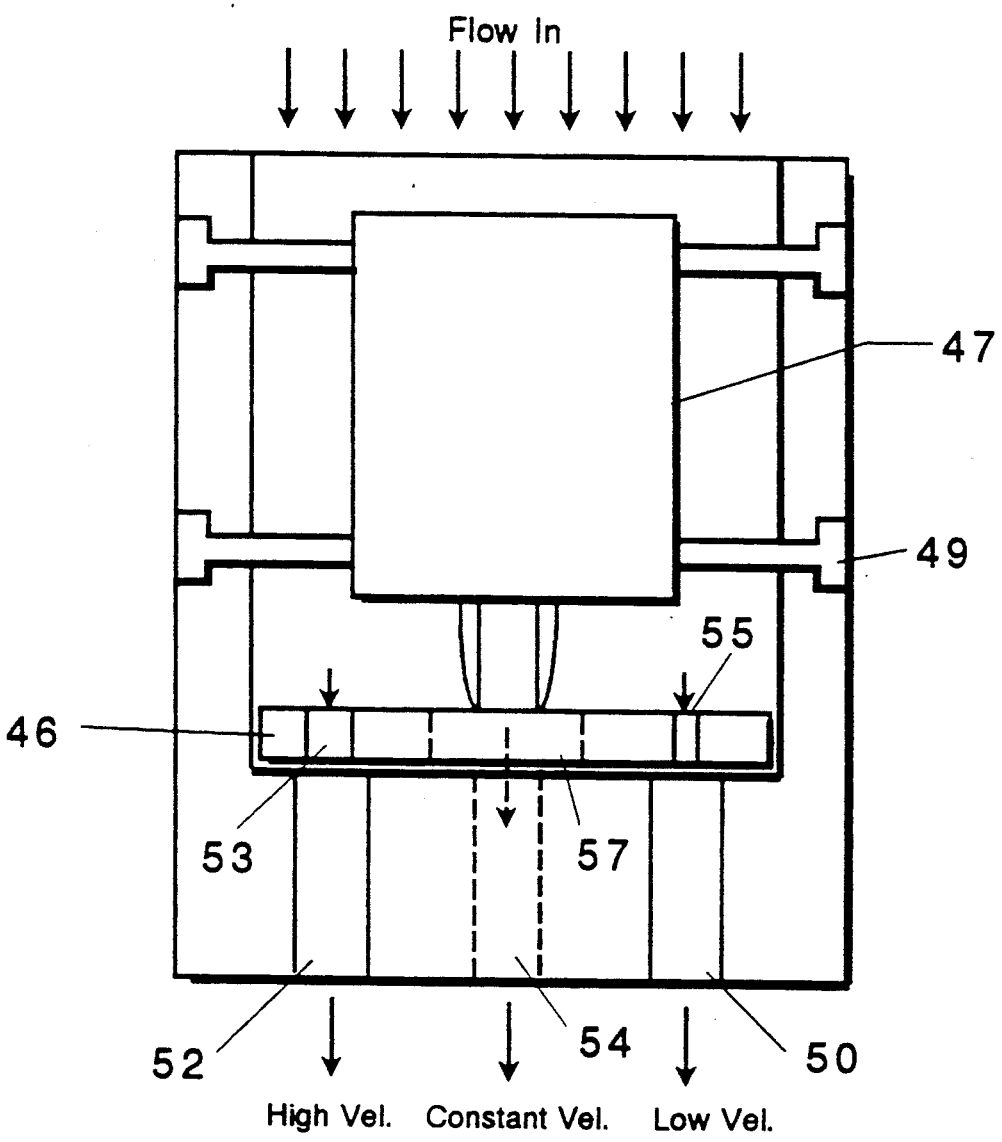
FIG. 4A is a diagrammatic perspective view of another embodiment of a preferential flushing system according to the invention.

Referring to FIG. 4A, an alternative embodiment of the valve assembly consists of an oscillating valve plate 46 driven by a rotary actuator 47 mounted on actuator supports 49. Oscillating valve plate 46 moves back and forth over two nozzles 50 and 52 of the three nozzle system. The plate also includes two holes 53 and 55 which cover a fraction of their respective nozzle ports and a larger third hole 57 to keep the third port 54 open at all times.

Figure 4B:
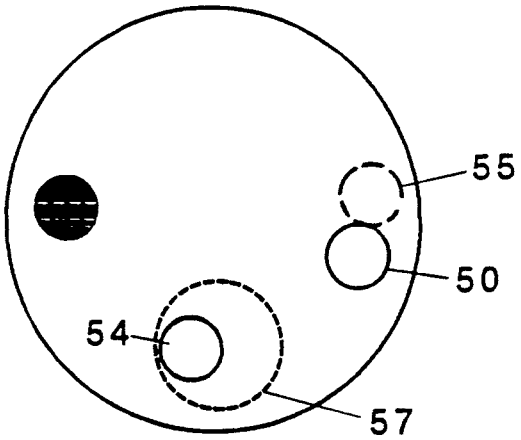
FIGS. 4B and 4C illustrate the operation of the preferential flushing system of FIG. 4A.
Figure 4B:
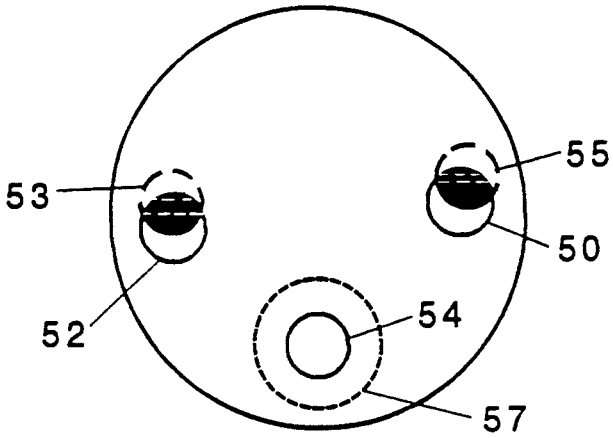
Figure 4B:
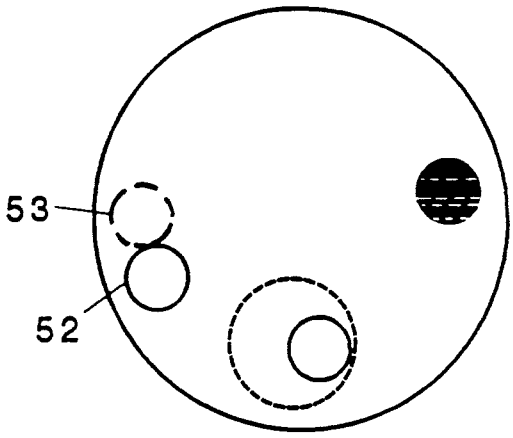

Referring to frames 1, 2, and 3 of FIG. 4B, as valve plate 46 turns, it covers more area of one nozzle port, and less area of the other port. This action causes an increase of the pressure across one nozzle while the pressure drop across the other. At the same time, the system maintains a constant pressure across the entire valve. The valve essentially reacts proportionally to the size of the tilt angle $\alpha$ of the tiltmeter (FIG. 5B).

Figure 4C:
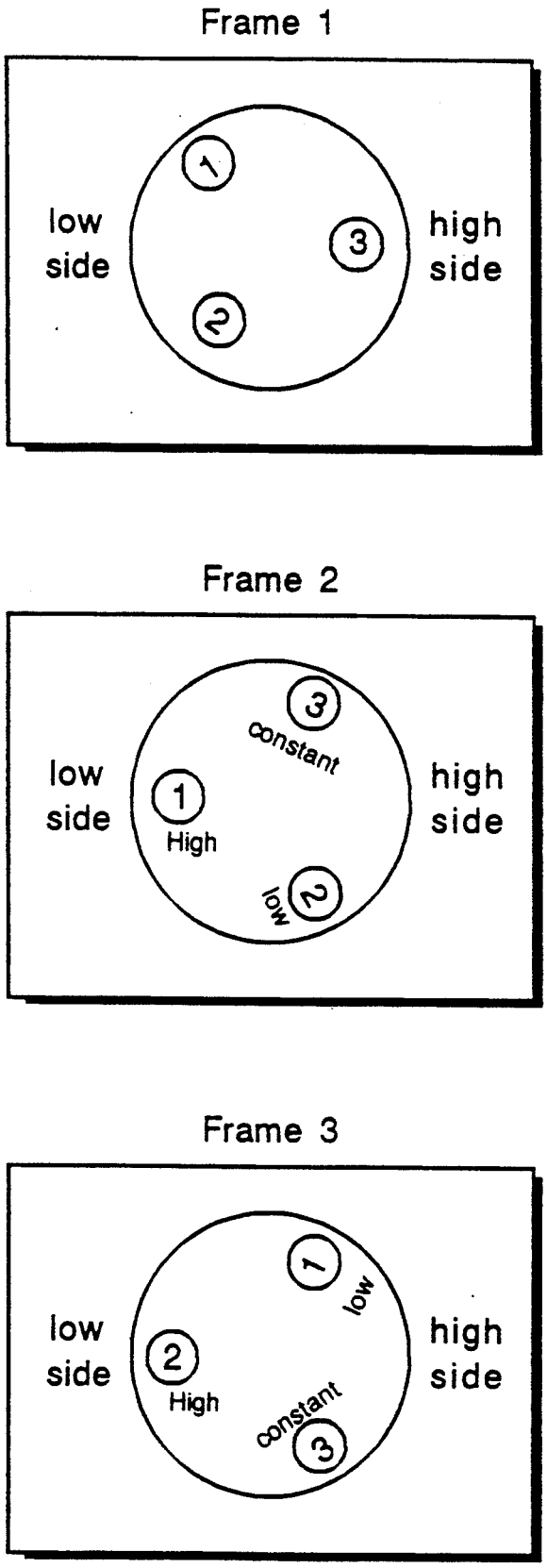

FIG. 4C shows a direction change sequence of the valve assembly. In frame 1 the first and second direction changing nozzles pass equal flow of fluid, causing no net change in direction.

As the bit rotates, the first nozzle is in phase with the low side of the hole (see frame 2), its flow is increased to cause increased penetration towards the low side, while at the same time the flow through the second nozzle is proportionally decreased, causing decreased penetration on the high side. The flow through the third nozzle is held constant at all times. Frame 3 completes one revolution of the bit, showing the second nozzle at high flow, and the first nozzle at low flow, while the third nozzle still remains at constant flow.

Referring to FIGS. 2 and 3, the net flushing effect together with the action of modified rollers 32 moves steerable pilot bit 12 towards the desired direction. The system pivots about point 15 that is laterally stabile since conical reamer 14 provides a tight fit between its rollers and the hole wall as it enlarges the hole.

For illustration purposes, the ports 50, 52, 53, 54, 55, and 57 in FIGS. 4A and 4B are shown to be circular, but in the actual system the ports may have shapes other than circular to prevent upstream pressure variations.

Figure 4D:
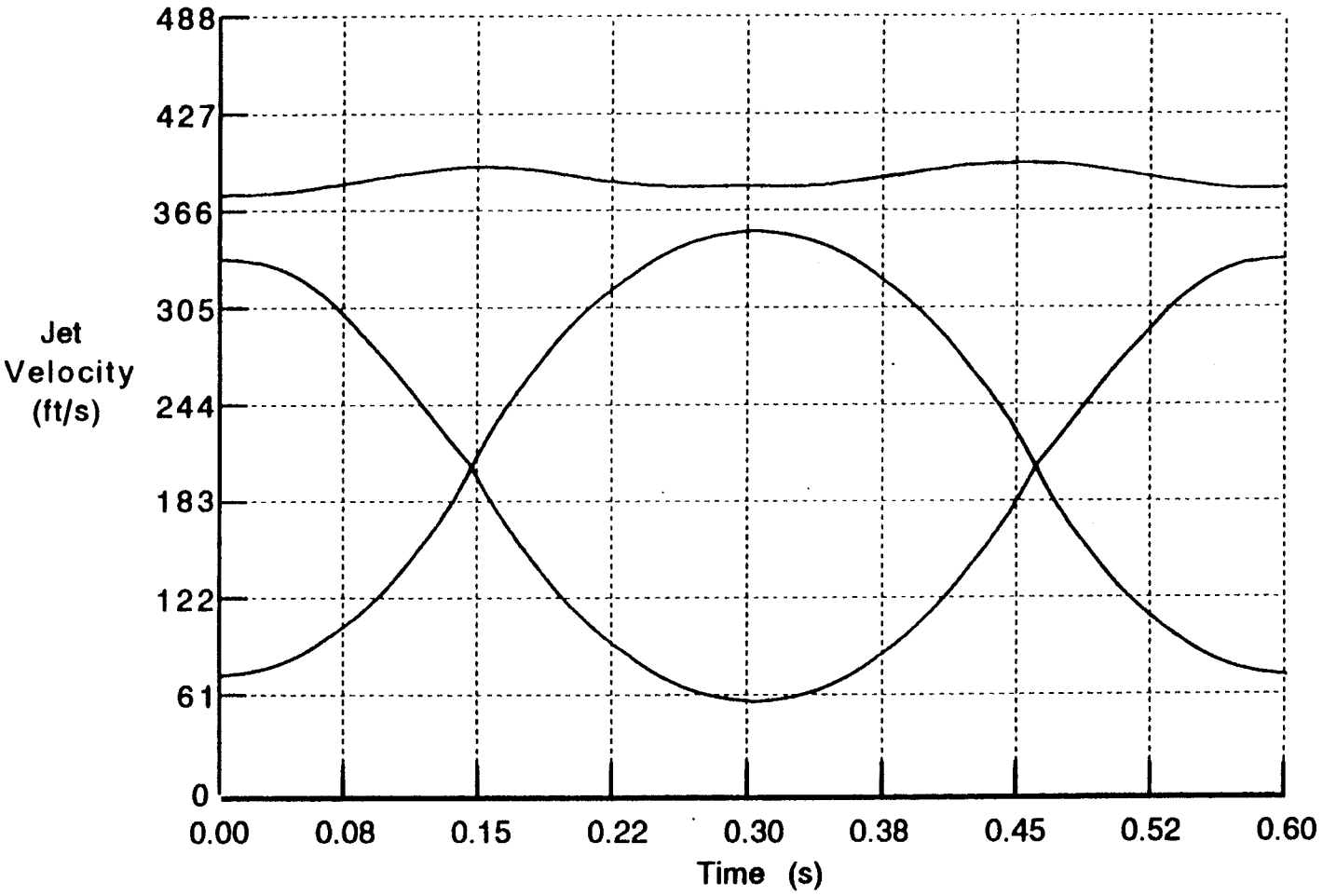
FIG. 4D is a graph of calculated jet velocity for one cycle of the flushing system of FIG. 4A.

The valve concept of FIG. 4A was modeled for a variable mass flow through ports 50 and 52 and constant flow through port 54. FIG. 4D is a plot of three fluid jet velocities as a function of time over one cycle. The jet velocities are calculated for a bit speed of 100 rpm. In the system, the "closed" valve area was 10% of the full open area and "leakage" flow exited to the wrong side of the bit. Modulated velocity, (calculated for ports 50 and 52,) ranges from 351 to 39 feet per second, while the independent open passage 54 remained nearly constant at about 400 feet per second. Given the evidence of a 15% variation in overall penetration rate for a minor change in nozzle placement, this 900% difference in velocity from one segment of the hole to another would surely result in considerable hole deviation.

Figure 5:
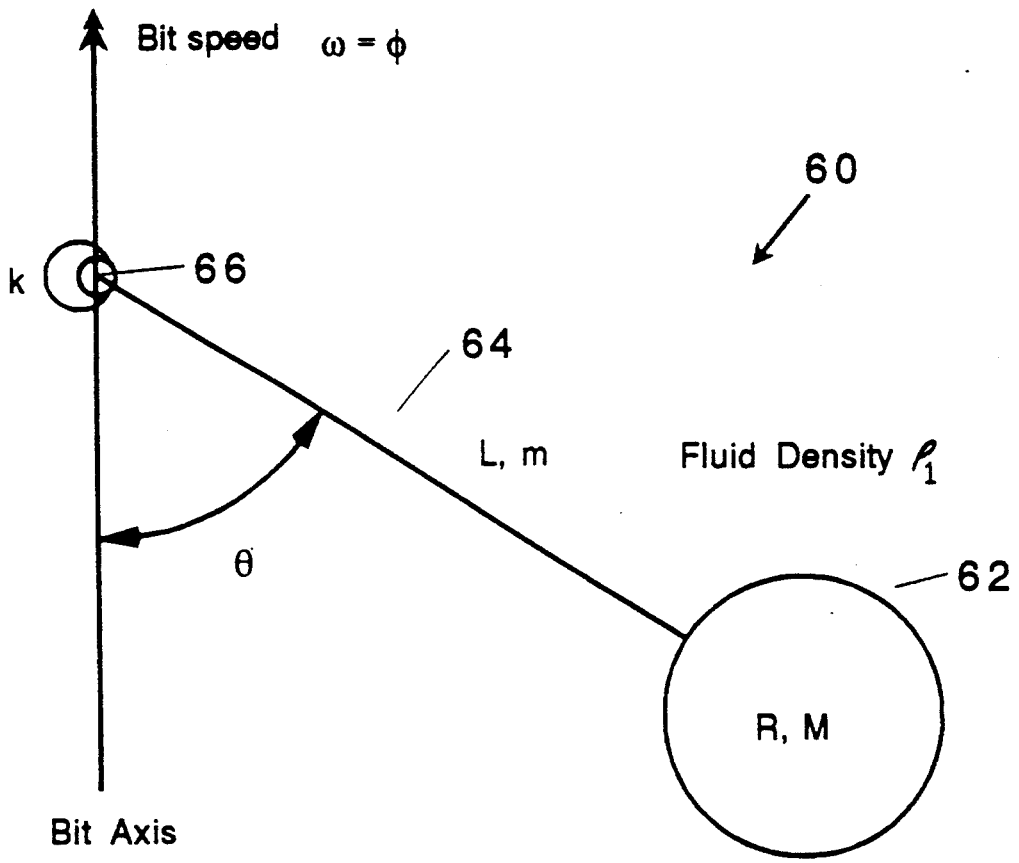
FIG. 5 is a schematic diagram of a pendulum of a tiltmeter according to the invention.

Refering to FIG. 5, the rotational tiltmeter includes a mechanical oscillator 60 such as a pendulum. The pendulum can be schematically shown as a mass 62 placed at the end of an arm 64, which is attached to a single-degree of freedom pivot point 66 on the drilling assembly, permitting the pendulum to swing in a plane.

In one embodiment, the pivot is implemented in the form of a flexure 70, as shown in FIG. 5B. This flexure is mounted to the shaft of the drilling assembly by a first pair of mount holes 72, and may be mounted to the arm of the pendulum by a second set of mount holes 74. The flexure supports four strain gauges 75, 76, 77, 78, two of which are bonded on each side of the flexure. The strain gauges are wired in a Wheatstone bridge configuration. The flexure acts as a transducer, as a hinge, and as a spring.

The mass of mass 62, the length of arm 64, the modulus of elasticity (which affects the spring stiffener) of flexure 70 and the tilt $\alpha$ define the natural period of oscillation of the pendulum. These parameters are selected to cause pendulum 60 to have a natural frequency of oscillation matched to the operating frequency of rotation of the drill steel. It is observed that the length of arm 64 and/or the modulus of elasticity of the flexure may be constructed to be dynamically varied. For example, a piezo-electric crystal may be bonded to the flexure so that flexure stiffness could be dynamically changed through the application of an appropriate voltage. The flexure would, in effect, become an "electronic spring".

In operation, the shaft of the drilling assembly is brought to its operating frequency of rotation, at which frequency it is generally used to drill into the earth. The speed of rotation of the shaft is governed by a control system which controls the motor that drives the shaft. If the drill shaft is vertical, the pendulum will hang vertically in a generally neutral position. If the shaft begins to tilt, such as due to the influence of non-uniform rock formations in the earth, gravity will exert a force on the mass 62 drawing it away from its neutral position. The pendulum, being mounted to pivot in a plane rotating with the shaft, will begin to oscillate back and forth.

Since the natural frequency of oscillation of the pendulum is matched to the operating frequency of rotation of the shaft, the pendulum oscillator will amplify this tilt-induced motion, producing oscillations of a higher amplitude than would otherwise be produced. These oscillations will generally lag the direction of tilt of the shaft by 90 degrees. This oscillatory amplification effect permits detection of very small angles of deflection.

Tilting of the shaft is detected by strain gauges 75, 76, 77, 78 on the flexure. Flexing of the flexure will cause the gauges mounted on one side 75, 76 of the flexure to contract while stretching the strain gauges on the other side 77, 78. This contraction and stretching will cause the electrical resistance of the strain gauges to change, which changes the balance of the Wheatstone bridge circuit.

The output of the Wheatstone bridge circuit is used by the computer, which generates a signal that is provided to the steerable pilot bit in order to cause the shaft to reorient the shaft in a more vertical direction. The computer takes the 90° sensor lag into consideration in generating this signal.

Alternatively, during drilling the length of the arm 64 and/or the stiffness of the flexure 70 may be varied dynamically to match a varying speed of operation of the drill string. The mechanical oscillator need not be a pendulum, but may instead include a mass and a spring. Furthermore, down-hole measurements of bit speed may be performed for feedback purposes, since the signal from the tiltmeter has the same frequency as the bit speed, but with different amplitude and phase.

It is observed that the tiltmeter of the invention may be viewed as a specialized accelerometer for use in a limited set of conditions.

Figure 5A:
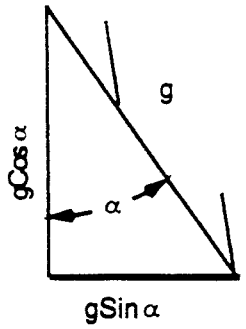
FIG. 5A is a diagram indicating the tilt of the tiltmeter.
Figure 5B:
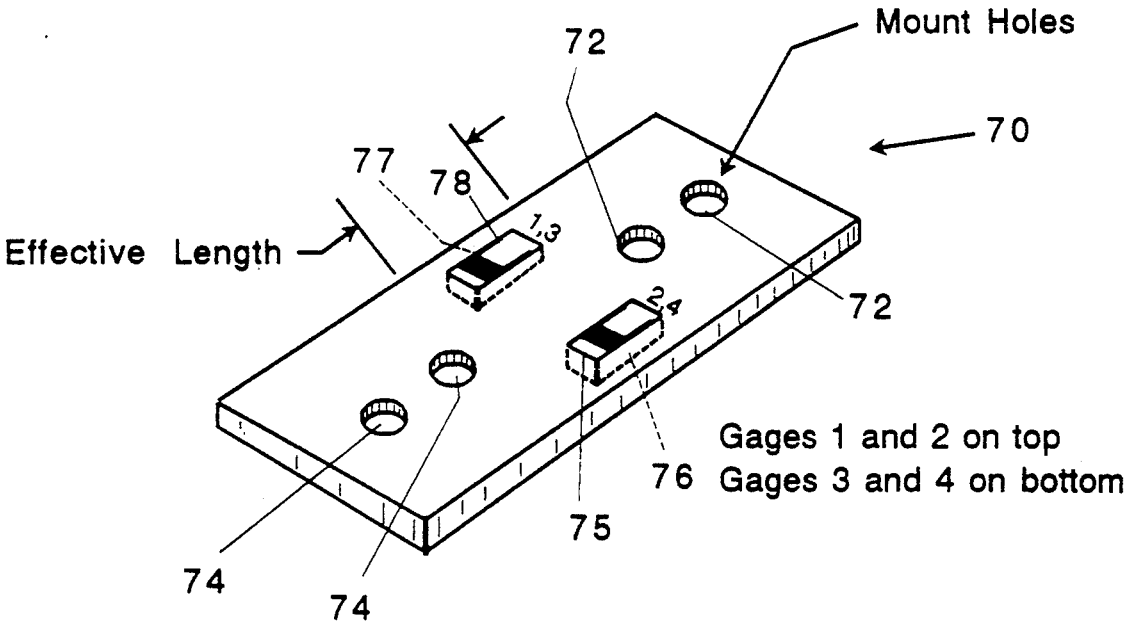
FIG. 5B is a perspective view of a flexure for use with the tiltmeter of FIG. 5.

In deriving a dynamic model of the rotating tiltmeter, we consider the simple planar pendulum fixed to the rotating bit axis by a two-dimensional hinge, and tilted at an angle $\alpha$, as shown in FIG. 5 (see also FIG. 5A). The pendulum is a cylindrical rod of length L, diameter D, and mass m connected to a spherical bob of radius R and mass M. The spring has an angular spring constant k and the fluid has density $\rho_1$. The angle defined by the bit axis and the arm 64 is $\Theta$. The bit axis spins at angular velocity $\omega$. The methods of Lagrangian Dynamics lead to the following nonlinear differential equation of motion in terms of $\Theta$ and $\omega$. (Crandall, Steven, *Dynamics of Mechanical and Electromechanical Systems.* New York: McGraw-Hill, 1990, 208)

$$\left[\frac{mL^2}{3} + M(L+R)^2 + \frac{2MR^2}{5}\right]\theta'' + k\theta + \left[\frac{mL}{2} + M(L+R)\right](g\mathrm{Cos}\alpha\mathrm{Sin}\theta - g\mathrm{Sin}\alpha\mathrm{Cos}\theta\mathrm{Cos}\phi) - \left[\frac{mL^2}{3} + M(L+R)^2\right]\mathrm{Sin}\theta\mathrm{Cos}\theta\omega^2 + b_1\theta'^2 + b_2\theta' = 0 \quad \text{EQ. 1}$$

(See Appendix A for its development)

The term that contains $b_1$ in equation 1 allows for the damping caused by the surrounding fluid, and the term containing $b_2$ accounts for damping in the pendulum pin joint. $b_1$ is related to the fluid density and pendulum dimensions based upon a frontal area approximation (White, Frank, *Fluid Mechanics*. 2nd ed. New York: McGraw Hill, 1989, 413). It is found from equation 2:

$$b_1 = \rho_f\left[\frac{1.2L^4D}{8} + \frac{.631\pi R^2(L+R)^3}{2}\right] \quad \text{EQ. 2}$$

(See Appendix B for its development)

It was desirable to linearize equation 1 so that insights into the pendulum motion could be gained. The damping terms containing $b_1$ and $b_2$ were combined to form a linearized equivalent damping $C_{eq}$ by energy methods. (Thomson, William, *Theory of Vibration With Applications*, 2nd ed. New Jersey: Prentice-Hall, 1981, 68–74). $C_{eq}$ is related to $b_1$ and $b_2$ by equation 3.

$$C_{eq} = \frac{1}{2}\left[b_2 + \sqrt{b_2^2 + \frac{32}{3\pi}C_2 g\,\mathrm{Sin}\alpha b_1}\right] \quad \text{EQ. 3}$$

(See Appendix C for its development)

Equation 1 was then linearized for the condition of small $\Theta$, constant $\omega$, and equivalent damping $C_{eq}$ to yield equation 4:

$$\theta'' + \left[\frac{k + C_2 g\,\mathrm{Cos}\alpha + C_3\omega^2}{C_1}\right]\theta + C_{eq}\theta' = \frac{C_2 g\,\mathrm{Sin}\alpha\,\mathrm{Cos}\phi}{C_1} \quad \text{EQ. 4}$$

The coefficients $C_1$, $C_2$ and $C_3$ used in equations 3 and 4 are defined as follows:

$$C_1 = \left[\frac{mL^2}{3} + M(L+R)^2 + \frac{2MR^2}{5}\right]$$

$$C_2 = \left[\frac{mL}{2} + M(L+R)\right]$$

$$C_3 = -\left[\frac{mL^2}{3} + M(L+R)^2\right]$$

Equation 4 is recognized as the standard equation for a damped harmonic oscillator of the form:

$$\theta'' + 2\zeta\omega_n\theta' + \omega_n^2\theta = F_o\mathrm{Sin}\omega t \quad \text{EQ. 5}$$

where $\zeta$, $\omega_n$ and $F_o$ are the familiar damping coefficient, natural frequency, and forcing function amplitude respectively.

Systems of this type will amplify the input signal presented by the forcing term on the right-hand side of the equation. Equations 4 and 5 show that the forcing function in the case of the straight-hole bit is a sinusoidal gravity term whose magnitude depends on the deviation angle $\alpha$. The solution to differential equation 4 is as follows (Thomson, William, *Theory of Vibration With Applications*. 2nd ed. New Jersey: Prentice-Hall, 1981, 49):

$$\theta = \theta\mathrm{Sin}(\omega t - \phi) \quad \text{EQ. 6}$$

Where

-continued $$\theta = \frac{C_2 g\,\mathrm{Sin}\alpha}{\sqrt{(k + C_2 g\,\mathrm{Cos}\alpha + C_3\omega^2 - C_1\omega^2)^2 + (C_{eq}\omega)^2}}$$

and $$\phi = \mathrm{Tan}^{-1}\left[\frac{C_{eq}\omega}{k + C_2 g\,\mathrm{Cos}\alpha + C_3\omega^2}\right]$$

Figure 6:
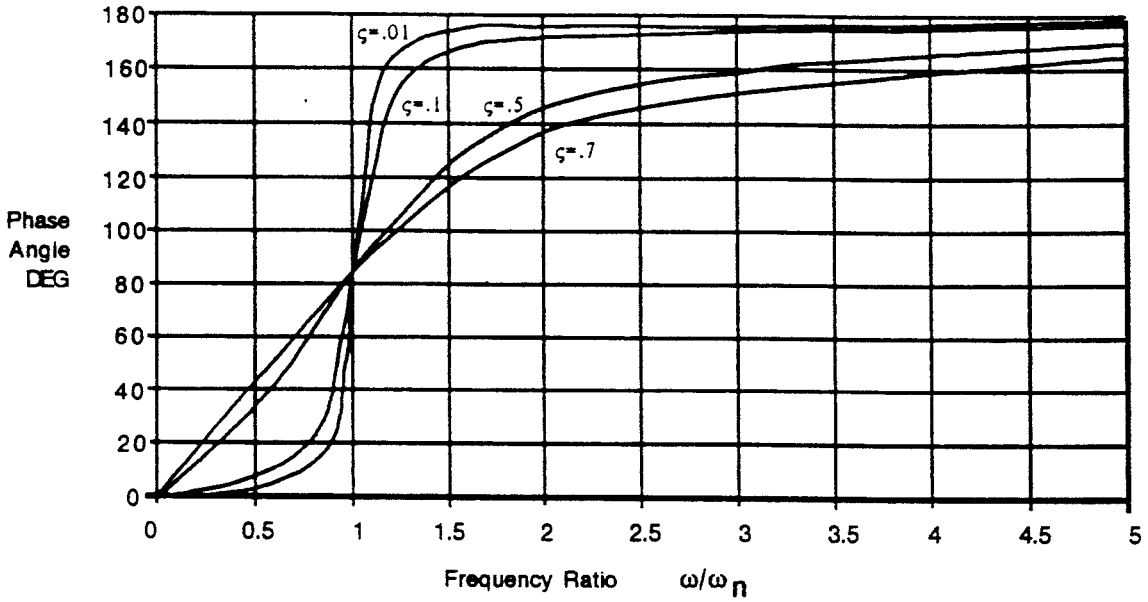
FIG. 6 is a plot of phase angle vs. frequency ratio for different damping ratios for a theoretical system described by equation 6.

Here $\Theta$ is the amplitude of the output signal, and $\phi$ is the phase lag between the forcing function and the output motion. Equation 6 says that for the sinusoidal gravity component forcing function, the output $\Theta$ will be at the same frequency and a different phase. This means that for a deviation angle greater than zero the pendulum will being to swing at the bit frequency $\omega$ at some phase offset from the low side of the hole. For a damped harmonic oscillator the phase offset is a function of excitation frequency relative to the natural frequency and damping ratio $\zeta$ as shown in FIG. 6. (Thomson, William, *Theory of Vibration With Applications*. 2nd ed. New Jersey: Prentice-Hall, 1981, 51).

The frequency ratio is defined as the bit frequency $\omega$ divided by the pendulum natural frequency $\omega_n$. For a given damping ratio, the phase lag approaches 0 degrees for frequency ratios below 1, and 180 degrees for frequency ratios above 1. The resonance condition occurs when the frequency ratio is equal to 1, resulting in a phase angle of 90 degrees. It is apparent that at the resonance condition, the phase angle is likely to be highly sensitive to changes in the damping ratio and the frequency ratio, particularly if there is little damping.

Figure 7:
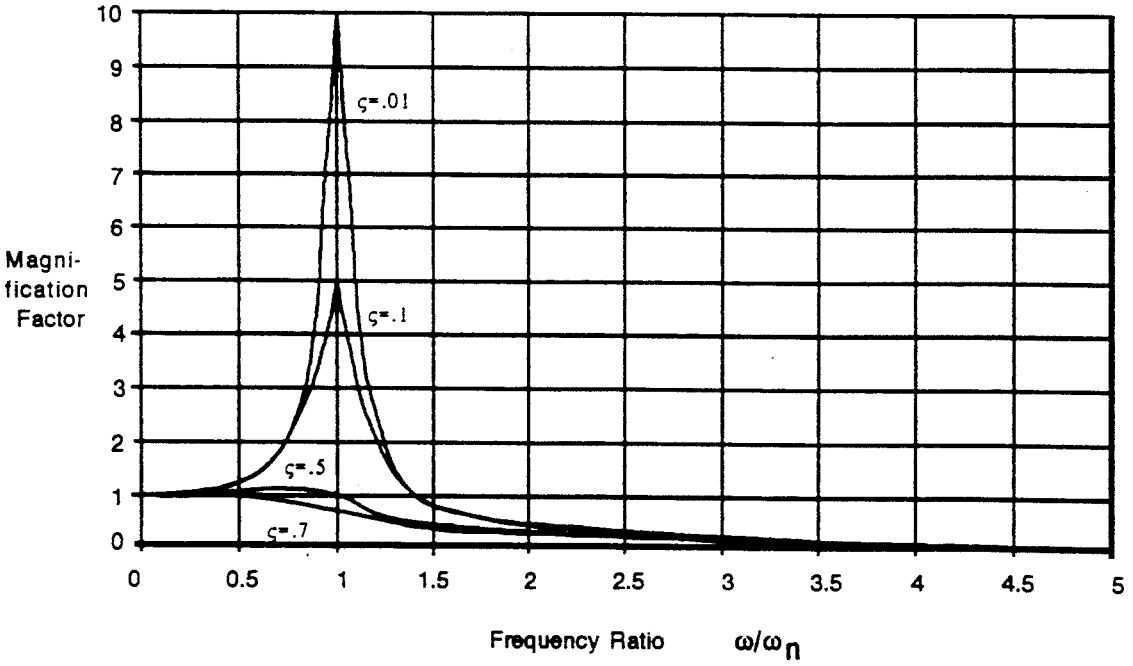
FIG. 7 is a plot of magnification factor against frequency ratio for different damping ratios for the theoretical system described by equation 6.

The magnitude of the output motion is also a function of frequency ratio and damping, as FIG. 7 shows. Here it is apparent that maximum amplification occurs at the resonance condition, and is strongly a function of the damping ratio. For the straight-hole bit, extremely small deviation angles must be resolved, meaning extremely small force must be amplified as much as possible by the pendulum. This suggests that the pendulum natural frequency should be matched to the bit rotation frequency so that the resonance condition occurs. Unfortunately the phase sensitivity is highest at resonance, indicating that there must be a sacrifice between signal amplification and phase error.

A computer program was developed to predict pendulum performance based upon inputs of the pendulum design characteristics, bit speed and deviation angle, and to evaluate the feasibility of the tiltmeter design. The program determines a natural frequency based on a specified spring coefficient from the following equation, which is developed from the $\theta$ coefficient in equations 4 and 5:

$$\omega_n = \sqrt{\frac{k + C_2 g\,\mathrm{Cos}\alpha + C_3\omega^2}{C_1}} \quad \text{EQ. 8}$$

Figure 8:
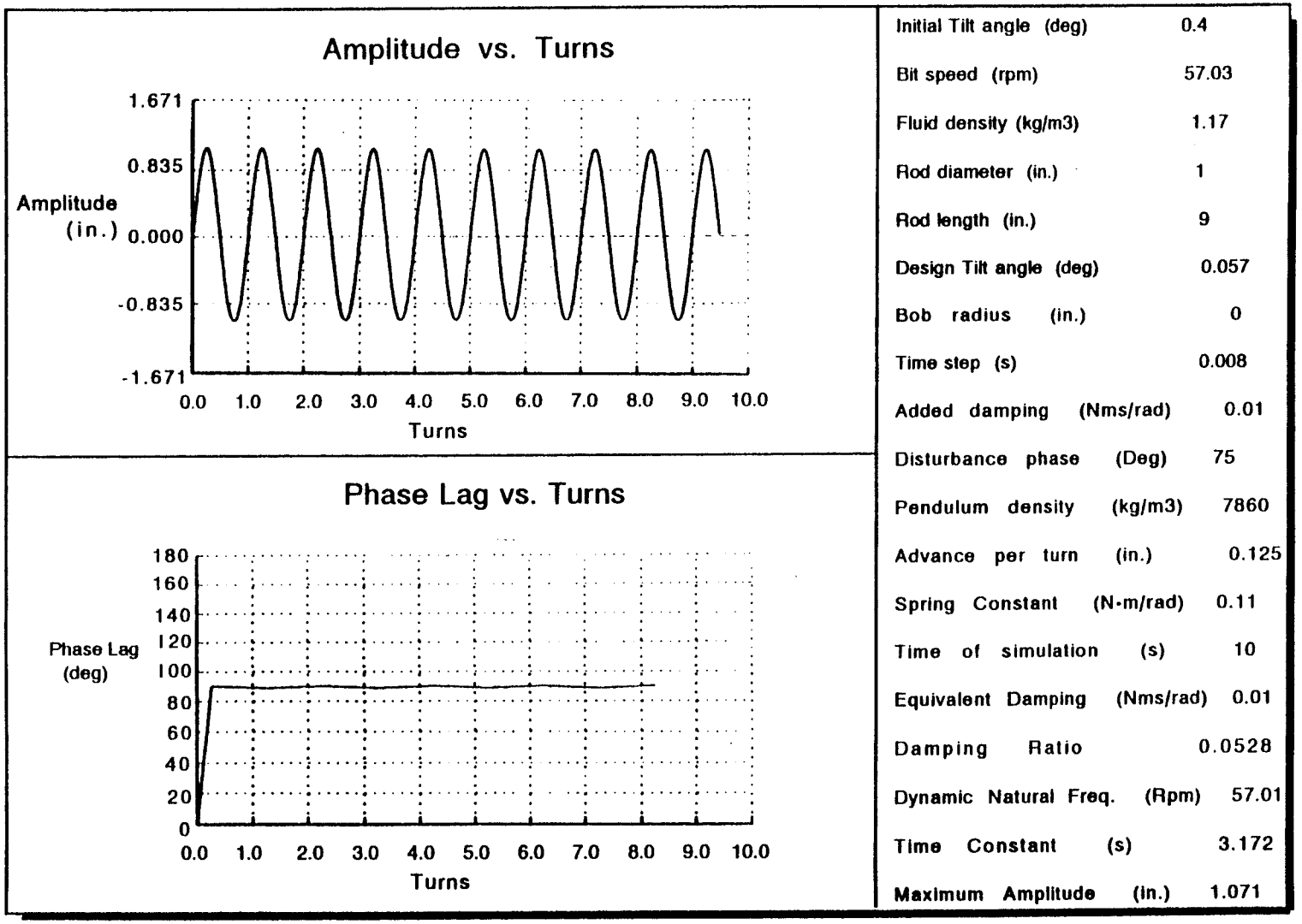
FIG. 8 is a copy of a formatted computer output sheet for a simulation of a tiltmeter.

Another feature of the program is its addition of a predicted noise term to the equation of motion of the pendulum. The lateral acceleration noise term added to equation 1 is as follows:

$$\text{noise} = \frac{d^2}{dt^2}\left(\frac{T}{L}\,\text{Sin}(3\omega t)\right) = -\frac{9\omega^2 T}{L}\,\text{Sin}(3\omega t) \qquad \text{EQ. 7}$$

where T is the advance per turn parameter, which was determined from empirical data to match typical drilling rates. Many design iterations were performed in order to derive desirable sets of pendulum dimensions and characteristics. These are presented in the right hand window of FIG. 8, next to results of an exemplary simulation. It should be noted that the pendulum dimensions are suitable for application in a drill bit.

It is interesting to note that pendulum designs with no added spring force can be found which satisfy the following equation:

$$\omega_n^2 C_1 - C_3\omega^2 31\ C_2 g \text{Cos}60 = 0 \qquad \text{EQ. 9}$$

It should also be noted that an external spring was used instead of relying totally upon a "gravity spring". Previous design iterations had shown that letting gravity provide the pendulum compliance require a relatively long pendulum, so it was felt that the addition of an external spring was necessary to allow for the use of a reasonably short pendulum, in this case.

The simulation was repeated for a series of tilt angles, which were run at the resonance condition. Simulations were also performed for the same design at rotational speeds above and below resonant speed, which indicated a rapid drop in amplitude and change in phase. Overall, the results of the simulations indicated that the rotating tiltmeter should be able to satisfy the specifications of the CORRTEX method requirements for tilt angles between 0.03 and 0.4 degrees even if the error happens to be in the same plane.

Figure 9:
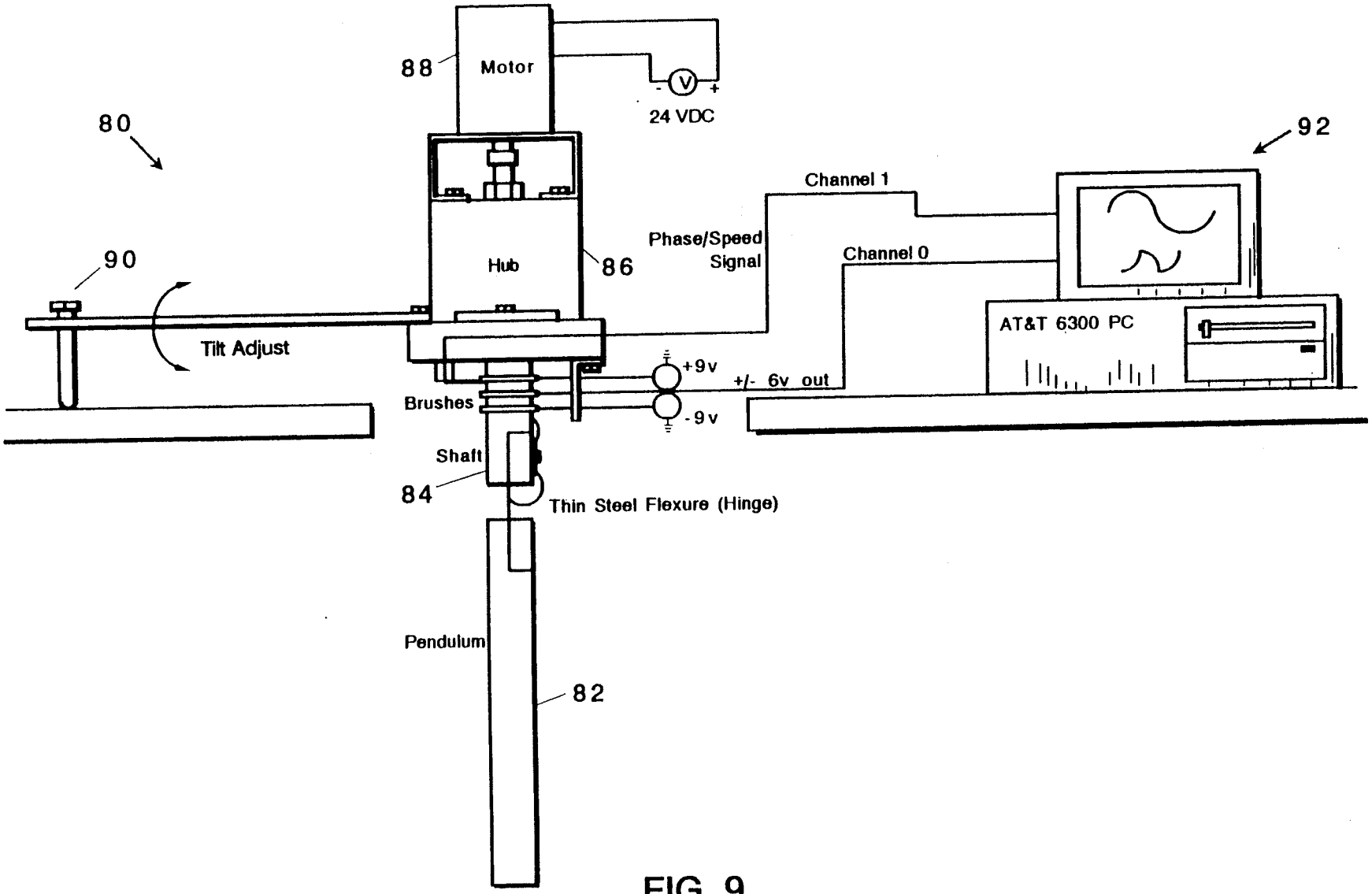
FIG. 9 is a diagram of test apparatus used in experiments relating to the feasibility of the tiltmeter.
Figure 10:
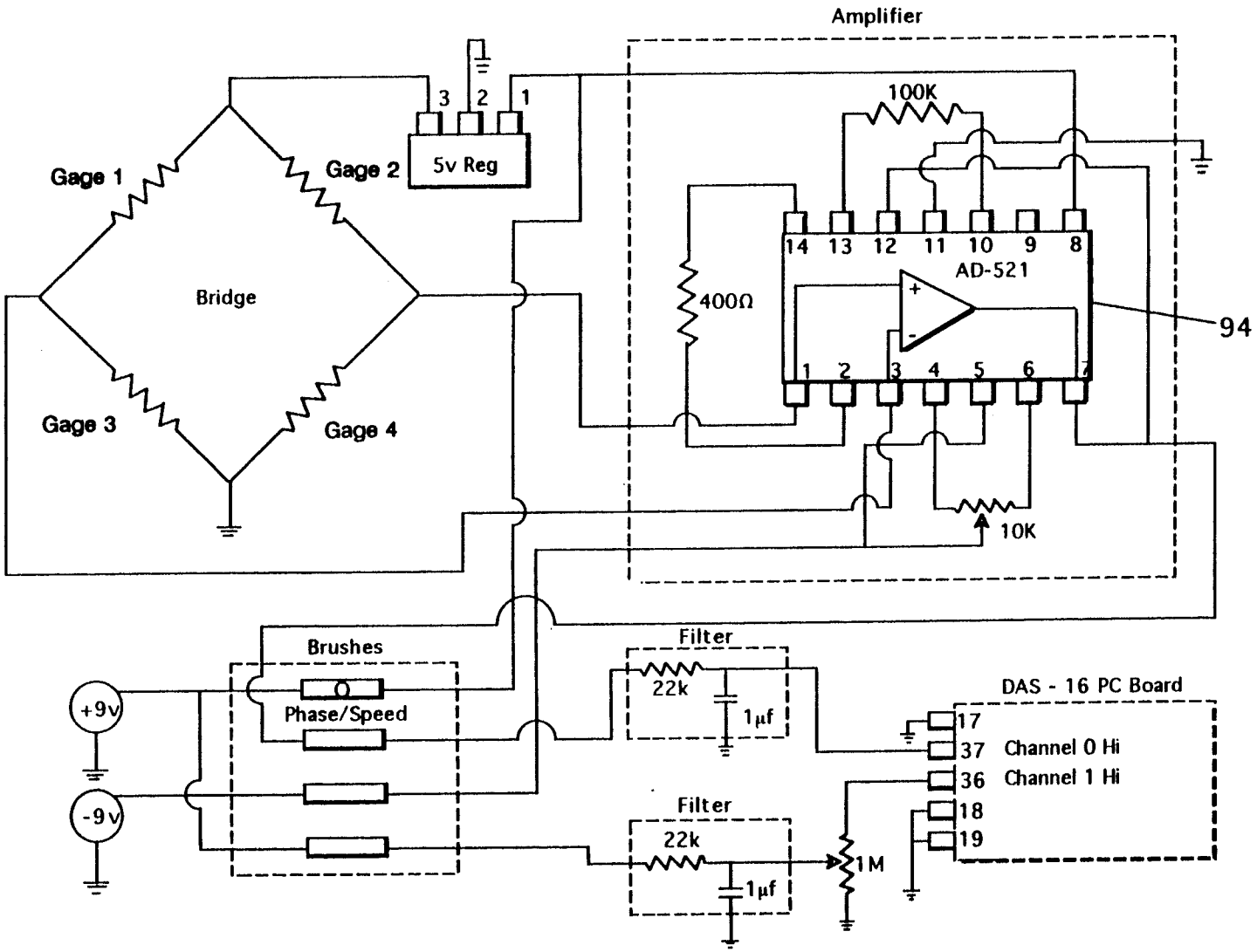
FIG. 10 is a circuit diagram used in connection with the test apparatus of FIG. 9.

A model device was designed for the purpose of testing the predictions made by the analytical rotating tiltmeter modes. FIG. 9 shows a schematic of the test apparatus 80. It consists of a pendulous mass 82 connected to a rotating shaft 84, which is supported by a bearing hub 86. One end of the shaft is driven by a 24 V.D.C. motor 88 For this reason, an amplifier circuit was used to bring the voltage range from the bridge circuit to +/−6 volts before passing it over the brushes. The amplifier circuit is shown in FIG. 10. It consists of an AD-521 Operational Amplifier 64 with two gain resistors and a trimming potentiometer for bridge balancing purposes. The circuit rotates with the pendulum and shaft, and receives voltage source inputs from two additional brushes. It is noted the in practical drilling situations, power would be obtained from a fluid-driven generator 24 on the shaft, so that power would not need to be provided by means of brushes. Furthermore, since the output of the tiltmeter is generally provided to the pilot bit, there need be no brushes in the system at all.

The output signal frequency was expected to be in the range of 0 to 3 Hz. Since only low frequencies were desired in the output, a simple low-pass filter was designed to eliminate high frequency signal components while avoiding intolerable phase lag. (See FIG. 4.15 for filter schematic). This circuit has a −3db point at 7 Hz (Horowitz, Paul and Winfield Hill, *The Art of Electronics*. 2nd ed. Cambridge: Cambridge UP, 1989, 36). Filtering occurs after the signal has passed over the brushes, so that brush noise can be reduced. Flexure bending causes an imbalance in the bridge circuit, producing a millivolt range input to the AD-521 Op-Amp 94. Op-Amp 94 receives supply voltages from two brushes. The signal is then amplified to the +/−6 volt range, and sent through the output brush. It then passes through the low-pass filter, leaving behind brush noise and other undesirable high frequency components, and enters the data acquisition board. (The same filtering would be applicable to a real device in the field.)

The pendulum phase angle and shaft speed are found by introducing a "sawtooth" signal on another channel of the to provide rotation. In this case the shaft tilt and speed are analogous to the tilt and speed of a real-world drill shaft. Three angular adjustment screws 90 provide a desired tilt with respect to gravity. A pendulum deflection transducer was connected between the pendulous mass and spinning shaft to indicate the motion of the mass (see FIG. 5). In a given test, the tilt was set at a desired angle via the adjustment screws, the shaft speed was adjusted to the pendulum natural frequency, and the resulting pendulum phase and amplitude signals from the deflection transducer were acquired by a PC-based data acquisition board 92.

For this test apparatus, it was necessary to take the pendulum deflection signal from the spinning pendulum-shaft combination to a data-acquisition board for analysis. FIG. 9 shows the pendulum deflection transducer circuitry in schematic form.

The transducer consists of a strain gage Wheatstone bridge (full bridge configuration) bonded to a thin steel flexure, as described earlier. The flexure is used as a transducer, as a hinge, and a spring. The flexure was modelled as a cantilever beam, and its spring constant was calculated based upon simple beam theory. The full-bridge configuration was used in order to minimize noise and thermal instabilities (Doebelin, Ernest, *Measurement Systems (Application and Desion)*. 4th ed. New York: McGraw-Hill, 1990, 226–228). When the transducer would bend, an imbalance would occur in the bridge, causing a nonzero voltage output from the bridge in the millivolt range. The test apparatus used a simple brush system to transfer the amplified signal from the spinning transducer to the stationary data acquisition board.

It was expected that brush contact irregularities would significantly disrupt a signal in the millivolt range. data acquisition board. The tip of the sharp point in the "sawtooth" signal occurs every time the spinning shaft reaches a certain angular position. This is done by placing a non-conducting strip and a fourth brush on the voltage input brush surface where the pendulum is aligned with the tilt axis. The "sawtooth" shape is provided by a capacitor and resistor combination. When the non-conducting strip passes under the phase/speed brush, the voltage signal causes the capacitor to leak from 5 volts toward zero exponentially until after the strip has passed by the brush, at which point the voltage signal moves exponentially back toward 5 volts. The peak of the sawtooth waveform occurs when the non-conducting strip is centered on the phase/speed brush. This point defines an angular reference position for the pendulum output signal in the test apparatus.

The device is supported by three adjustable legs (not shown) which rest on a heavy steel table, and is connected to a D.C. power supply. An AT&T 6300 computer fitted with a Metrabyte DAS-16 data acquisition board (Metrabyte Corporation, Dash-16 Manual. Massachusetts: Metrabyte Corporation, 1984) was used to gather and process the pendulum output data. A computer program was written to convert voltage signal data to displacement data based upon a static calibration of voltage output versus pendulum deflection.

Although this model exhibited behavior that included somewhat large differences with respect to the predicted amplitudes and phase errors, these discrepancies are attributable to factors such as the approximate nature of the model using linear differential equations to describe the nonlinear system, and to the fact that amplitude and phase are extremely sensitive to changes in speed and damping in a system with such a low damping coefficient. Despite these differences the amplitudes were found to be sufficiently large and the phase errors were found to be sufficiently small to meet the design requirements. The analytical model was therefore capable of predicting the general behavior of the real-world system, and a good estimate of the resonant speed.

In one experiment, at a speed approximately 8% lower than the resonant speed, the amplitude decreased by 69% and the phase became erratic. This illustrates how sensitive the rotating tiltmeter is to speed changes with such low damping, and points to the fact that speed changes of more than a few percent are intolerable for this particular design.

It should be noted that the resonant speed of the rotating tiltmeter is a function of both the tilt angle and the rotation speed (See Equation 8), which means that a chosen "resonant speed" really only applies at one point in the range of tilt, but is used as an average resonant speed over the whole range.

Overall, the results of experiments seem to indicate that the test apparatus is capable of resolving tilt angles in the range of 0.03 to 0.4 degrees with tolerable phase error, provided that the rotation speed is held constant to within approximately +/−5%.

The sinusoidal output of the rotating tiltmeter would typically be used for straight-hole drilling in connection with a steerable bit, such as a steerable pilot bit employing preferential flushing. The tiltmeter could be used to trigger the valve of the bit that causes preferential flushing, provided that the phase angle between the output signal and the low side of the hole is known. To compensate for a nonzero phase angle, the steerable pilot bit nozzles could be physically placed out of the plane of motion of the rotating tiltmeter pendulum.

In evaluating the feasibility of using a tiltmeter according to the invention in such a system, a 3D kinematic model was developed. The model was used to predict the path followed by a system of typical assembly length with varying tiltmeter phase errors in the range of 0 to 180 degrees. The effects of rock induced drift were also simulated. The simulation carried out assumed a 10% correction component. That is, the correction component simulates the action of a preferential flushing system which causes lateral penetration on one side of the hole, which is 10% of the total advance per turn. The results of this simulation show a correction rate greater than 1 ft in every 10 ft of drilling (1.34 ft in 10 ft), due to the fact that correction takes place in a nonlinear fashion. This simulation indicates that a preferential flushing correction of only 10% should be sufficient to correct the deviations of the proposed straight hole drilling system.

Simulations were made for cases in which the tiltmeter phase error, the difference between the predicted phase lag and the actual phase lag is between 0 and 90 degrees. In these cases the pilot bit tends to converge toward the vertical in an inward spiral. The spiral converges at a rate inversely proportional to the particular phase error in each case. This means that the straight-hole drilling system will be relatively insensitive to phase error. For this reason the optimal pendulum design is one which has a natural frequency equal to the bit speed (the resonance condition). As mentioned earlier, maximum signal amplification occurs at resonance, so that prime importance has been placed upon amplitude response, and less importance has been placed on phase error. In most applications a balance between amplitude and phase tradeoffs must be found. In order for resonance to occur, the bit speed must be adjusted until the following condition occurs:

$$\omega = \sqrt{\frac{k + C_2 g \cos\alpha}{C_1 - C_3}} \qquad \text{EQ. 10}$$

This equation states that the natural frequency coefficient found in equation 10 is equal to the excitation frequency (the bit speed).

Since analysis of the design has shown that phase errors of up to 90 degrees are tolerable in the rotating tiltmeter, and since the maximum Tiltmeter error occurring in the test case was 68 degrees, it was concluded that the rotating tiltmeter meets the design requirements in terms of phase stability.

OTHER EMBODIMENTS

The invention envisions different types of orientation sensors adapted to detect orientation of the drilling assembly in 3 dimensions and to provide control signal to the preferential flushing system and/or the steerable pilot bit.

In one embodiment, the orientation sensor is a mechanical oscillator that is suspended vertically within drill steel case 16 (FIG. 2) and forms a predetermined angle $\psi$ with axis 11 of the drilling assembly. The mass of the oscillator is located on an oscillator flexure that is attached to the shaft on a rotatable joint that enables the oscillator to remain in the neutral, vertical position while the shaft rotates about its axis and is oriented at the angle $\psi$ from the vertical. The angle $\psi$ between the flexure and the shaft can be set dynamically. If the direction of the shaft deviates from the predetermined angle $\psi$, the joint exerts a force on the flexure that displaces the oscillator from the vertical position, and the oscillator starts to oscillate by gravity action. The oscillations are sensed by a transducer mounted on the flexure. The transducer can include the above-described four strain gauges and can generate control signals in the same way as the above-described tiltmeter. However, since the plane of the flexure does not rotate with the shaft, there is no amplification effect observed, as is for the tiltmeter with its natural frequency matched to the frequency of rotation of the shaft.

In other embodiments, the orientation sensor is formed by an oscillator and a compass, a ring laser gyroscope, or a set of moving gyroscopes adapted to provide 3-dimensional sensing and guidance of the shaft oriented in any selected direction.

Other embodiments are within the scope of the following claims.

APPENDIX A

Pendulum Dynamics

The methods of Lagrangian Dynamics were used to develop the nonlinear differential equation which is used in the Rotating Tiltmeter motion simulation program. The generalized coordinates are Θ and Φ. Here Φ is a cyclic coordinate. The kinetic energy T* of the Rotating Tiltmeter is as follows:

$$T^* = \frac{1}{2} m \left( \frac{L}{2} \theta'^2 \right) + \frac{1}{2} (M(L+R)\theta')^2 + \frac{1}{2} \left( \frac{1}{12} mL^2\theta'^2 \right) + \frac{1}{5} MR^2\theta'^2 + \frac{1}{2} m \left( \frac{L}{2} \omega \mathrm{Sin}\theta \right)^2 + \frac{1}{2} M((L+R)\omega \mathrm{Sin}\theta)^2 + \frac{1}{2} \left( \frac{1}{12} mL^2 \right) \omega^2 \mathrm{Sin}^2\theta + \frac{1}{5} MR^2\omega^2 \quad \text{EQ. A.12}$$

The potential energy V of the tiltmeter expressed as a function of the spring constant k, tilt angle α, and gravity g is as follows:

$$V = \frac{1}{2} k\theta'^2 - mg \frac{L}{2} \mathrm{Sin}\theta \mathrm{Sin}\alpha \mathrm{Cos}\phi - Mg((L+R)\mathrm{Sin}\theta \mathrm{Sin}\alpha \mathrm{Cos}\phi - mg \frac{L}{2} \mathrm{Cos}\theta \mathrm{Cos}\alpha - Mg(L+R)\mathrm{Cos}\theta \mathrm{Cos}\alpha \quad \text{EQ. A.13}$$

The following derivatives were taken so that Lagranges equation could be constructed:

$$\frac{\partial}{\partial t} \left( \frac{\partial T^*}{\partial \theta'} \right) = \frac{mL^2}{4} \theta'' + M(L+R)^2\theta'' + \frac{1}{12} mL^2\theta'' + \frac{2}{5} MR^2\theta'' \quad \text{EQ. A.14}$$

$$\frac{\partial V}{\partial \theta} = k\theta' + \left( m \frac{L}{2} + M(L+R) \right) (g\mathrm{Cos}\alpha \mathrm{Sin}\theta - g\mathrm{Sin}\alpha \mathrm{Cos}\theta \mathrm{Cos}\phi) \quad \text{EQ. A.15}$$

$$\frac{\partial T^*}{\partial \theta} = m \frac{L^2}{4} \omega^2 \mathrm{Sin}\theta \mathrm{Cos}\theta + m(L+R)^2\omega^2 \mathrm{Sin}\theta \mathrm{Cos}\theta + \frac{1}{12} mL^2\omega^2 \mathrm{Sin}\theta \mathrm{Cos}\theta \quad \text{EQ. A.16}$$

Lagranges equation is formed from equations A.14 through A.16 as follows:

$$\frac{\partial}{\partial t} \left( \frac{\partial T^*}{\partial \theta'} \right) + \frac{\partial V}{\partial \theta} - \frac{\partial T^*}{\partial \theta} + b_2\theta' + b_1\theta' SGN(\theta') = 0 \quad \text{EQ. A.17}$$

Here SGN(Θ') denotes a function which adjusts the sign of the second order damping term so that the term always subtracts energy from the system. The damping terms containing $b_1$ and $b_2$ enter into Lagranges equation as external forces.

After some algrebraic grouping, equation A.17 is equivalent to the nonlinear differential equation of motion of the Rotating Tiltmeter (See Equation 1).

APPENDIX B

Fluid Damping Coefficient Based Upon Frontal Area

The nonlinear damping coefficient $b_1$ accounts for the damping contribution of the fluid surrounding the Rotating Tiltmeter pendulum. It was developed based upon the frontal area of the pendulum and pendulum bob of the Rotating Tiltmeter. The following equation relates to fluid drag force to the drag coefficient $C_d$, fluid velocity V, and frontal area A (White, Frank. Fluid Mechanics, *2nd ed. New York: McGraw Hill,* 1989, 78):

$$C_d = \frac{F_d}{\frac{1}{2} \rho_f V^2 A} \quad \text{EQ. A.1}$$

In the case of the Rotating Tiltmeter Pendulum, the differential form of this equation must be used since the pendulum is swinging and the velocity varies along its length. For this reason the velocity and area variables are functions of pendulum angular velocity Θ', pendulum diameter D, and the position along the pendulum length X as follows:

$$V = X\theta' \quad EQ.A.2$$

$$dA = DdX \quad EQ.A.3$$

Substitution of these relations into equation A.1 and solving for the differential force due to fluid damping on the pendulum leads to the following equation:

$$dF_d \tfrac{1}{2} C_d \rho_f X^2 \theta'^2 DdX \quad EQ.A.4$$

Since the differential equation for the pendulum dynamics is in terms of torque, it is necessary to multiply equation A.4 by X to yield the expression for the differential torque $T_p$ on the pendulum due to fluid damping:

$$dT_p = \tfrac{1}{2} C_d \rho_f X^3 \theta'^2 DdX \quad EQ.A.5$$

Equation A.5 is then integated over the length of the pendulum to find the total torque on the pendulum due to fluid damping:

$$T_p = \frac{1}{2} \int_0^L C_d \rho_f X^3 \theta'^2 DdX = \frac{1}{8} C_d \rho_f L^4 D\theta'^2 \quad \text{EQ. A.6}$$

The torque contribution due to fluid damping on the pendulum bob comes from the drag force expression of equation A.1 multiplied by length at which the force acts (L+R), as well as a substitution for the bob frontal area:

$$T_b = \tfrac{1}{2} C_b \rho_f L^2 \theta'^2 (\pi R^2) \quad EQ.A.7$$

Where $T_b$=bob torque and $C_b$=bob drag coefficient. The total fluid damping torque seen by the pendulum and bob is simply the sum of equations A.6 and A.7:

$$T_{tot} = [\tfrac{1}{2}\pi R^2 C_b \rho_f L(L+R)^3 + \tfrac{1}{8} C_d \pi \rho_f L^4 D]\theta'^2 = b_1\theta'^2 \quad \text{EQ.A.8}$$

Substitution of 0.631 and 1.2 for drag coefficients $C_b$ and $C_d$ respectively leads directly to equation 2 which allows b1 to be found (See White, Frank. Fluid Mechanics, 2nd ed. New York: McGraw Hill, 1989, pp. 417–418 for drag coefficient determinations).

APPENDIX C

Equivalent Damping Model

The equivalent damping coefficient $C_{eq}$ is the linearized equivalent of the damping coefficients $b_1$ and $b_2$ discussed in section 4.3. The linearization was carried out by using the energy method outlined by Thomson. The pendulum work done by the linear and nonlinear damping terms ($W_d$) over one period of motion can be found by applying the integral below, and can be equated to the amount of work done by the equivalent damping coefficient $C_{eq}$.

$$W_d = \int_0^{\pi} (b_2\theta' + b_1\theta'^2)d\theta = \int_0^{\pi} C_{eq}\theta' d\theta \qquad \text{EQ. A.9}$$

Substitution of the linearized differential equation solution for Θ (See Equation 6) into these integrals, and then evaluating them leads to the following equation relating $b_1$ and $b_2$ to $C_{eq}$:

$$C_{eq} = \frac{8b_1}{3\pi}\omega\theta + b_2 \qquad \text{EQ. A.10}$$

At the resonance condition, the output amplitude is related to $C_{eq}$ by the following equation (Thomson, William. Theory of Vibration With Applications. 2nd ed. New Jersey: Prentice-Hall, 1981, 73):

$$\theta = \frac{F_o}{C_{eq}\omega} \qquad \text{EQ. A.11}$$

The substitution of this equation into the previous equation leads directly to equation 3 which provides an equivalent damping coefficient $C_{eq}$ for given $b_1$ and $b_2$.

What is claimed is:

1. A guided drilling system for drilling in a desired direction comprising:
   - a rotatable drilling shaft driven by a motor adapted to drive said drilling shaft,
   - an orientation sensor, located on said rotatable drilling shaft, constructed and arranged to detect deviation of said shaft from said desired direction during rotation of said shaft while drilling, said sensor adapted to produce control signals dependent upon said detected deviation,
   - a steerable bit, mounted on the end of said drilling shaft, adapted to drill in said desired direction by utilizing multiple fluid jets disposed to provide preferential flushing at a selected region,
   - a tight stabilizer mounted on a stiff section of said drilling shaft at a location spaced substantially above said steerable bit to provide a known pivot point for deflecting that enables correction of the drilling direction by said steerable bit, and
   - fluid modulation means, responsive to said sensor, adapted to regulate said jets of fluid to achieve preferential flushing in response to said signals from said sensor to correct detected deviation of said shaft from said desired direction.

2. A guided drilling system for drilling in a desired direction comprising:
   - a rotatable drilling shaft driven by a motor adapted to drive said drilling shaft,
   - an orientation sensor, located on said rotatable drilling shaft, constructed and arranged to detect deviation of said shaft from said desired direction during rotation of said shaft while drilling, said sensor adapted to produce control signals dependent upon said detected deviation,
   - a steerable pilot bit, mounted on the end of said drilling shaft, adapted to drill in said desired direction by utilizing a mechanical cutter in conjunction with multiple fluid jets disposed to provide preferential flushing at a selected region,
   - a conical reamer mounted on a stiff section of said drilling shaft at a location spaced substantially above said steerable pilot bit to provide a known pivot point for deflection that enables correction of the drilling direction by said pilot bit, said conical reamer adapted to enlarge the diameter of a hole formed by said pilot bit while providing a tight lateral constraint to said shaft, and
   - fluid modulation means, responsive to said sensor, adapted to regulate said jets of fluid to achieve preferential flushing in response to said signals from said sensor to correct detected deviation of said shaft from said desired direction.

3. The system of claim 1 or 2 wherein said orientation sensor is a tiltmeter that comprises:
   - a mechanical oscillator carried by said rotatable shaft, said mechanical oscillator including a mass disposed in a generally neutral position when said shaft, while rotating, is oriented in said desired direction, said oscillator caused to oscillate by gravity action when said shaft, while rotating, deviates from said desired direction,
   - said oscillator adapted to have its natural frequency of oscillation matched to the operating frequency of rotation of said shaft to enable said oscillator to amplify tilt-induced oscillations,
   - a transducer coupled to said oscillator adapted to sense the oscillations of said oscillator, and
   - indication means responsive to said transducer for determining the phase relationship of the oscillations relative to the angular position of said shaft and producing signals of said shaft deviation from said desired direction.

4. The system of claim 3 further comprising a motor control means adapted to maintain the speed of said motor driving said drilling shaft at frequency matched with said natural frequency of said mechanical oscillator.

5. The system of claim 3 wherein said fluid modulation means receive said signals from said indication means and directs said fluid to said selected region in order to maintain said shaft in a desired orientation.

6. The system of claim 5 wherein said fluid modulation means are constructed and adapted to maintain said shaft vertical in order to drill a vertical hole without stopping said rotation of said shaft.

7. The system of claim 5 wherein said fluid modulation means receive said signals from said indication means nearly continually.

8. The system of claim 5 wherein said fluid modulation means receive said signals from said indication means intermittently.

9. The system of claim 3 wherein said indication means of said tiltmeter obtain said signals by determining a direction of tilt that leads said oscillations of said mechanical oscillator by 90°.

10. The system of claim 3 wherein said natural frequency of said mechanical oscillator is dynamically adjustable, and said tiltmeter further including means for matching said natural frequency to the frequency of rotation of said shaft.

11. The system of claim 10 wherein said mechanical oscillator is a pendulum including a mass pivotably mounted within said shaft.

12. The system of claim 11 wherein said pendulum is constrained to move in a plane.

13. The system of claim 11 wherein said pendulum includes a flexure mounted within said shaft and pivotably supports said mass.

14. The system of claim 3 wherein said transducer means comprises a strain gauge.

15. The system of claim 1 or 2 wherein said steerable bit includes:

a modified roller bit having cutter cones adapted to provide a chamfered hole bottom.

16. The system of claim 1 or 2 wherein said steerable bit includes:

a roller cutter adapted for controlled drilling in a desired direction, and multiple jet nozzles, each connected to a fluid passage delivering said fluid to said respective nozzle, adapted to introduce said fluid to said selected region in order to increase drilling rate in said region.

17. The system of claim 16 wherein said fluid modulation means comprise a flow control valve adapted to direct said fluid to said fluid passage of a selected nozzle in order to achieve said preferential flushing.

18. The system of claim 17 wherein said flow control valve comprises a rotating disc adapted to control delivery of said fluid to said fluid passages.

19. For detecting deviation from vertical of a rotating shaft, a tiltmeter mounted on said shaft and comprising:

a mechanical oscillator carried by said rotatable shaft, said mechanical oscillator including a mass disposed in a generally neutral position when said shaft, while rotating is vertical and being caused to oscillate by gravity action when said shaft, while rotating, deviates from the vertical, said oscillator adapted to have its natural frequency of oscillation matched to the operating frequency of rotation of said shaft, to enable said oscillator to amplify tilt-induced oscillations, a transducer coupled to said oscillator adapted to sense the oscillations of said oscillator, and indication means responsive to said transducer for determining the phase relationship of the oscillations relative to the angular position of said shaft and producing said signals of said shaft deviation from vertical.

20. The tiltmeter of claim 19 wherein said indication means obtain said signals by determining a direction of tilt that leads said oscillations of said mechanical oscillator by 90°.

21. The tiltmeter of claim 19 wherein said natural frequency of said mechanical oscillator is dynamically adjustable, and further including means for matching said natural frequency to the frequency of rotation of said shaft.

22. The tiltmeter of claim 19 further including a surface motor for driving said shaft, and control means for maintaining the speed of said motor matched with said natural frequency of said mechanical oscillator.

23. The tiltmeter of claim 19 wherein said mechanical oscillator is a pendulum including a mass pivotably mounted within said shaft.

24. The tiltmeter of claim 23 wherein said pendulum is constrained to move in a plane.

25. The tiltmeter of claim 23, wherein said pendulum includes a flexure mounted within said shaft and pivotably supports said mass.

26. The tiltmeter of claim 19 further comprising dynamic shaft steering means responsive to said indication means for dynamically steering said shaft.

27. The tiltmeter of claim 26 wherein said shaft steering means is constructed and adapted to maintain said shaft vertical in order to drill a vertical hole without stopping said rotation of said shaft.

28. The tiltmeter of claim 19 wherein said transducer means comprise a strain gauge.

29. A method of drilling in a desired direction comprising the steps of:

(a) providing a rotating drilling shaft driven by a motor, (b) providing a tight stabilizer mounted on a stiff section of said drilling shaft at a location spaced substantially above a steerable bit to provide a known pivot point for deflection that enables correction of the drilling direction by said steerable bit, (c) drilling in the desired direction by using said steerable bit mounted on the end of said drilling shaft, said steerable bit utilizing multiple fluid jets for providing preferential flushing at a selected region, (d) detecting deviation of said shaft from said desired direction during rotation of said shaft, while drilling, using an orientation sensor located on said rotating drilling shaft, said sensor producing control signals dependent upon said detected deviation, and (e) regulating said jets of fluid using fluid modulation means for achieving directional drilling by said preferential flushing, said fluid modulation means being responsive to said signals from said sensor detecting deviation of said shaft from said desired direction.

30. A method of drilling in a desired direction comprising the steps of:

(a) providing a rotating drilling shaft driven by a motor, (b) drilling in said desired direction by using a steerable pilot bit mounted on the end of said drilling shaft, said steerable bit utilizing a mechanical cutter in conjunction with multiple fluid jets for providing preferential flushing at a selected region, (c) enlarging the diameter of a hole formed by said pilot bit using a conical reamer mounted on a stiff section of said drilling shaft at a location spaced substantially above said steerable pilot bit to provide a known pivot point for deflection that enables correction of the drilling direction by said pilot bit, said conical reamer providing a tight lateral constraint to said shaft, (d) detecting deviation of said shaft from said desired direction during rotation of said shaft, while drilling, using an orientation sensor located on said rotating drilling shaft, said sensor producing control signals dependent upon said detected deviation, and (e) regulating said jets of fluid using fluid modulation means for achieving directional drilling by said preferential flushing, said fluid modulation means being responsive to said signals from said sensor detecting deviation of said shaft from said desired direction.

31. The method of claim 29 or 30 wherein said step of detecting deviation of said shaft comprises:

(a) providing a mechanical oscillator carried by said rotating shaft, said mechanical oscillator including a mass disposed in a generally neutral position when said shaft, while rotating, is oriented in said desired direction, said oscillator caused to oscillate by gravity action when said shaft, while rotating, deviates from said desired direction, (b) rotating the shaft at a frequency approximately matching a natural frequency of said oscillator, so as to allow the oscillator to amplify tilt-induced motion of the oscillator, and (c) obtaining an indication of the direction of tilt from the phase relationship of the oscillations relative to the angular position of the shaft and producing signals of said shaft deviation from said desired direction.

32. The method of claim 31 further comprising the step of controlling the speed of said motor driving said drilling shaft to maintain frequency matched to said natural frequency of said mechanical oscillator.

33. The method of claim 31 wherein said step of regulating said jets includes sending said deviation signal to fluid modulation means for directing said fluid to said selected region in order to maintain said shaft in said desired direction.

34. The method of claim 33 wherein said desired direction is substantially vertical.

35. The method of claim 31 wherein said step of obtaining an indication of the direction is performed nearly continually.

36. The method of claim 31 wherein said step of obtaining an indication of the direction is performed intermittently.

37. The method of claim 31 further comprising the steps of (a) dynamically adjusting said natural frequency of said mechanical oscillator, and (b) matching said natural frequency to said frequency of rotation of said shaft.

38. The method of claim 31 wherein said mechanical oscillator is constrained to move in a plane.

39. The method of claim 29 or 30 wherein said step of drilling in said desired direction includes using a modified roller bit having cutter cones to provide a chamfered hole bottom.

40. The method of claim 29 or 30 wherein said step of drilling in said desired direction includes:

(a) directional drilling using a roller cutter associated with said steerable pilot bit, and (b) introducing said fluid to said selected region using multiple jet nozzles each connected to a fluid passage delivering said fluid to said respective nozzle, said jet nozzles being adapted to increase drilling rate in said desired direction.

41. The method of claim 40 wherein said regulating step includes directing said fluid to said fluid passage of a selected nozzle in order to achieve said preferential flushing.

42. A method of detecting deviation from the vertical of a rotating shaft comprising the steps of:

(a) providing a mechanical oscillator carried by said rotating shaft, said mechanical oscillator including a mass disposed in a generally neutral position when said shaft, while rotating, is oriented in the vertical, said oscillator caused to oscillate by gravity action when said shaft, while rotating, deviates from the vertical, (b) rotating the shaft at a frequency approximately matching a natural frequency of said oscillator, so as to allow said oscillator to amplify tilt-induced oscillations, and (c) obtaining an indication of the direction of tilt from the phase relationship of the oscillations relative to the angular position of the shaft and producing signals of said shaft deviation from the vertical.

43. The method of claim 42 wherein the mechanical oscillator is constrained to move in a plane.

44. The method of claim 42 further including the step of dynamically steering the shaft based on the obtained indication.

45. The method of claim 42 further including the step of adjusting the natural frequency of the mechanical oscillator to match the frequency of rotation of the shaft.

* * * * *

UNITED STATES PATENT AND TRADEMARK OFFICE

CERTIFICATE OF CORRECTION

PATENT NO. : 5,314,030

DATED : May 24, 1994

INVENTOR(S) : Carl R. Peterson, et al

It is certified that error appears in the above-indentified patent and that said Letters Patent is hereby corrected as shown below:

Col. 11, line 17, in the equation, change "31" to read "-" and change "60" to read --$\alpha$--.

Col. 11, line 42, after "88" move the text found in col. 12, lines 10-46 which starts with "to provide" and ends with "range." to this location;

Col. 12, line 36, change "Desion" to read --Design--.

Col. 16, line 37, in the equation, change "$dF_d$" to read --$dF_d$=--.

Col. 16, line 66, in the equation, change "$C_d\pi$" to read --$C_dp$--.

Signed and Sealed this

Nineteenth Day of December, 1995

*Attest:*

*Attesting Officer*

BRUCE LEHMAN

*Commissioner of Patents and Trademarks*